US009124008B2

(12) United States Patent
Higgy et al.

(10) Patent No.: US 9,124,008 B2
(45) Date of Patent: Sep. 1, 2015

(54) ELECTRICAL CONNECTOR

(71) Applicant: Tyco Electronics Corporation, Berwyn, PA (US)

(72) Inventors: Mohamed Hussein Higgy, Redwood City, CA (US); Kevin Matthew Hogan, Sinking Spring, PA (US); Robert John Mills, III, Womelsdorf, PA (US); Michael John Spicer, Lancaster, PA (US); David Lehman Miller, Landisville, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/014,037

(22) Filed: Aug. 29, 2013

(65) Prior Publication Data

US 2015/0064977 A1 Mar. 5, 2015

(51) Int. Cl.
*H01R 9/03* (2006.01)

(52) U.S. Cl.
CPC ..... *H01R 9/032* (2013.01)

(58) Field of Classification Search
CPC ..... H01R 13/6275; H01R 9/032
USPC ..... 439/492, 497, 499, 715, 712, 470, 439/607.41, 607.42, 607.44, 607.46, 439/607.47, 607.49
See application file for complete search history.

(56) References Cited

U.S. PATENT DOCUMENTS 6,036,543 A * 3/2000 Panis et al. ..... 439/607.01
6,129,593 A * 10/2000 Aoyama et al. ..... 439/701
6,203,377 B1 * 3/2001 Grek et al. ..... 439/607.44
6,585,536 B1 * 7/2003 Wu ..... 439/358
6,585,537 B1 * 7/2003 Lee ..... 439/358
6,655,979 B1 * 12/2003 Lee ..... 439/357
6,817,898 B2 * 11/2004 Tanaka et al. ..... 439/579
6,821,139 B1 * 11/2004 Wu ..... 439/352
6,830,480 B2 * 12/2004 Yoshioka ..... 439/607.42
6,857,899 B2 * 2/2005 Reed et al. ..... 439/497
6,860,749 B1 * 3/2005 Wu ..... 439/352
6,860,750 B1 * 3/2005 Wu ..... 439/358
6,890,191 B1 * 5/2005 Thorburn ..... 439/98
6,890,205 B1 * 5/2005 Wu ..... 439/358
6,951,474 B1 * 10/2005 Wu ..... 439/358
6,976,865 B2 * 12/2005 Wu ..... 439/352
7,086,888 B2 * 8/2006 Wu ..... 439/358
7,090,534 B2 * 8/2006 Wu et al. ..... 439/607.41
7,160,136 B2 * 1/2007 Zhang et al. ..... 439/357
7,223,121 B2 * 5/2007 Moriyama et al. ..... 439/497
7,267,573 B2 * 9/2007 Sato et al. ..... 439/492
7,285,017 B2 * 10/2007 Mitra et al. ..... 439/607.41
7,442,072 B2 * 10/2008 Droesbeke et al. ..... 439/471
7,534,143 B1 * 5/2009 Tsao et al. ..... 439/607.41

(Continued)

*Primary Examiner* — Ross Gushi

(57) ABSTRACT

An electrical connector includes a shell having a mating end and a termination end. The shell has a securing feature configured to secure the shell to a mating connector. The shell has a cavity that extends between the mating end and the termination end. A terminal subassembly includes a dielectric insert that is configured to be held within the cavity of the shell. The dielectric insert is configured to hold terminals such that mating interfaces of the terminals are configured to mate with corresponding terminals of the mating connector and such that termination interfaces of the terminals are configured to be terminated to a cable. The dielectric insert is a modular insert that is configured to hold the terminals when the termination interfaces are flat interfaces and is also configured to hold the terminals when the termination interfaces are crimp interfaces.

20 Claims, 7 Drawing Sheets

(56) References Cited

U.S. PATENT DOCUMENTS

| | | | | |
|---|---|---|---|---|
| 7,717,733 | B1 * | 5/2010 | Yi et al. | 439/452 |
| 7,744,402 | B2 * | 6/2010 | Wu | 439/455 |
| 7,780,466 | B1 * | 8/2010 | Wu | 439/354 |
| 7,794,279 | B1 * | 9/2010 | Ye et al. | 439/607.54 |
| 7,824,221 | B2 * | 11/2010 | Miyoshi | 439/607.41 |
| 7,828,589 | B2 * | 11/2010 | Cheng | 439/497 |
| 7,883,359 | B2 * | 2/2011 | Osaki et al. | 439/492 |
| 7,922,532 | B2 * | 4/2011 | Su et al. | 439/607.23 |
| 7,972,172 | B2 * | 7/2011 | Huang et al. | 439/578 |
| 8,002,568 | B2 * | 8/2011 | Searby | 439/358 |
| 8,152,566 | B1 * | 4/2012 | Little et al. | 439/607.41 |
| 8,197,281 | B2 * | 6/2012 | Yang | 439/499 |
| 8,398,427 | B2 * | 3/2013 | Wu | 439/497 |
| 8,403,698 | B2 * | 3/2013 | Su et al. | 439/455 |
| 8,439,708 | B2 * | 5/2013 | Colantuono et al. | 439/660 |
| 8,517,748 | B1 * | 8/2013 | Kelsch et al. | 439/188 |
| 8,708,718 | B2 * | 4/2014 | Li et al. | 439/108 |
| 8,721,361 | B2 * | 5/2014 | Wu | 439/497 |
| 8,740,652 | B2 * | 6/2014 | Hsueh | 439/660 |
| 8,764,486 | B2 * | 7/2014 | Ii | 439/607.46 |
| 8,784,136 | B2 * | 7/2014 | Siahaan et al. | 439/607.55 |
| 8,794,995 | B2 * | 8/2014 | Wu | 439/497 |
| 8,870,596 | B2 * | 10/2014 | Ii | 439/607.41 |
| 2007/0155243 | A1 * | 7/2007 | Watanabe et al. | 439/610 |
| 2008/0132112 | A1 * | 6/2008 | Nagata et al. | 439/499 |
| 2009/0215290 | A1 * | 8/2009 | Zhu et al. | 439/76.1 |
| 2011/0021061 | A1 * | 1/2011 | Bishop et al. | 439/357 |
| 2014/0220821 | A1 * | 8/2014 | Wu et al. | 439/607.41 |

* cited by examiner

ELECTRICAL CONNECTOR

BACKGROUND OF THE INVENTION

The subject matter herein relates generally to electrical connectors.

Photovoltaic (PV) systems produce electricity from solar energy. Various components of the PV system are interconnected using cables and electrical connectors that terminate the cables. For example, components of PV systems that are interconnected via cables may include PV modules or arrays that are used to generate electricity (e.g., solar panels and/or the like), and/or other PV components used within a PV system (e.g., power storage devices, sensors, controllers, and/or the like). While PV systems are often used on land, for example to provide electrical power to a residence or commercial building, PV systems may be used in outer space, in orbit around the earth, and/or on-board satellites.

Known electrical connectors are not without disadvantages. For example, the terminals of many electrical connectors are terminated to the conductors of the corresponding cable using solder. But, such solder terminations may fail due to extreme thermal cycling experienced in outer space and earth orbit environments. Moreover, many electrical connectors use fluorosilicone components, for example as sealing gaskets and/or within cable clamps (e.g., for strain relief) of the electrical connectors that clamp to the cable. Such fluorosilicone materials may also fail due to the extreme thermal cycling experienced in outer space and earth orbit environments. Accordingly, at least some known electrical connectors are not suitable for use in outer space and/or earth orbit environments, particularly over relatively extended periods of time. For example, at least some known electrical connectors are not suitable for use onboard a satellite.

BRIEF DESCRIPTION OF THE INVENTION

In an embodiment, an electrical connector includes a shell having a mating end and a termination end. The shell has a securing feature configured to secure the shell to a mating connector. The shell has a cavity that extends between the mating end and the termination end. A terminal subassembly includes a dielectric insert that is configured to be held within the cavity of the shell. The dielectric insert is configured to hold terminals such that mating interfaces of the terminals are configured to mate with corresponding terminals of the mating connector and such that termination interfaces of the terminals are configured to be terminated to a cable. The dielectric insert is a modular insert that is configured to hold the terminals when the termination interfaces are flat interfaces and is also configured to hold the terminals when the termination interfaces are crimp interfaces.

In an embodiment, an electrical connector includes a shell having a mating end and a termination end. The shell has a securing feature configured to secure the shell to a mating connector. The shell has a cavity that extends between the mating end and the termination end. The electrical connector includes a terminal subassembly having terminals that are held within the cavity of the shell. The terminals include termination interfaces that are configured to be terminated to a cable. The electrical connector includes a cable clamp having opposing clamping members that are configured to clamp the cable therebetween at the termination end of the shell. Each clamping member having a unitary body that includes both an actuation segment and a pressing surface. The pressing surfaces are configured to face each other and engage the cable therebetween. The actuation segment of each clamping member is configured to cooperate with the other clamping member to move the pressing surfaces toward each other. At least one of the pressing surfaces has a shape that is complementary with a shape of the cable.

In an embodiment, an electrical connector includes a shell having a mating end and a termination end. The shell has a securing feature configured to secure the shell to a mating connector. The shell has a cavity that extends between the mating end and the termination end. The electrical connector includes a terminal subassembly having a dielectric insert held within the cavity of the shell and terminals that are held by the dielectric insert. The dielectric insert includes a front face having a base surface and towers that extend outward from the base surface. The front face is configured to mate with another dielectric insert of the mating connector as the electrical connector mates with the mating connector such that the towers nest within corresponding openings of the other dielectric insert of the mating connector.

DETAILED DESCRIPTION OF THE INVENTION

Figure 1:
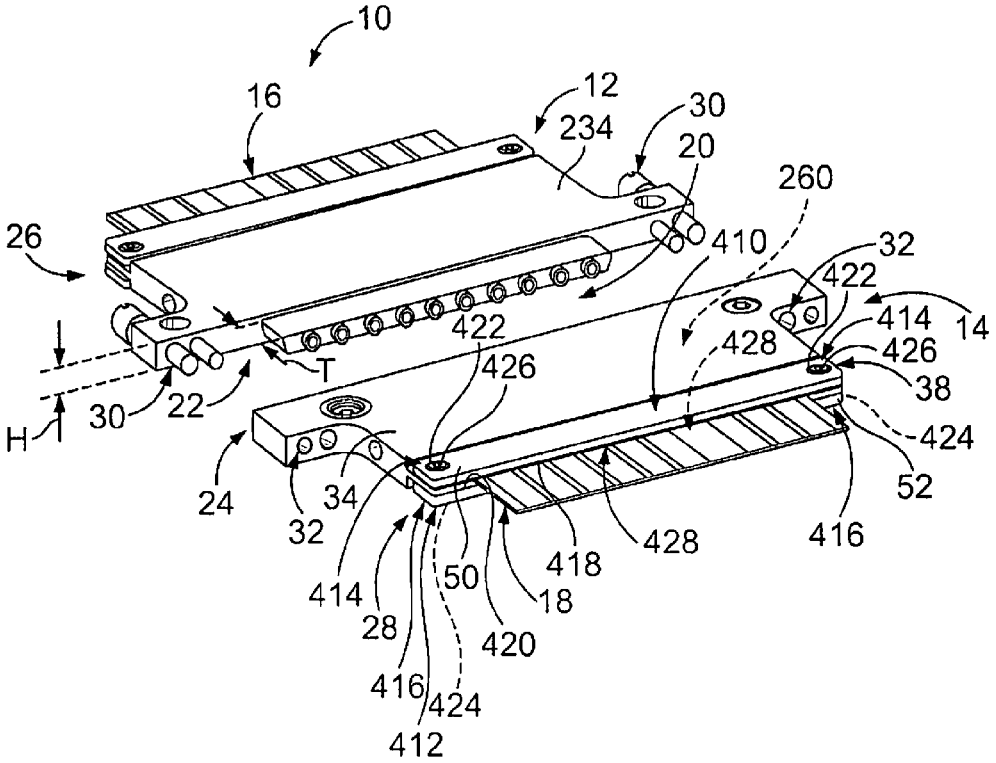
FIG. 1 is an exploded view of an embodiment of an electrical connector system.

FIG. 1 is an exploded perspective view of an embodiment of an electrical connector system 10. The connector system 10 includes electrical connectors 12 and 14, which are configured to be mated together. The electrical connectors 12 and 14 are terminated to ends of respective cables 16 and 18. The cables 16 and 18 are terminated to corresponding electrical components (not shown). Each of the electrical components may be any type of electrical component. In some embodiments, one or more of the electrical components is an electrical component of a photovoltaic (PV) system, such that the electrical connector system 10 is a PV connector system. Examples of electrical components of PV systems include, but are not limited to, PV modules or arrays that are used to generate electricity (e.g., solar panels and/or the like), and/or other PV components used within a PV system (e.g., power storage devices, sensors, controllers, and/or the like). In some embodiments, the electrical components are components of a PV and/or other system that is configured to operate in outer space, that is configured to operate in orbit around the earth, and/or that is located on-board a satellite. Accordingly, in some embodiments, the electrical connector system 10 is configured to operate in outer space, is configured to operate in orbit around the earth, and/or is located on-board a satellite.

Figure 6:
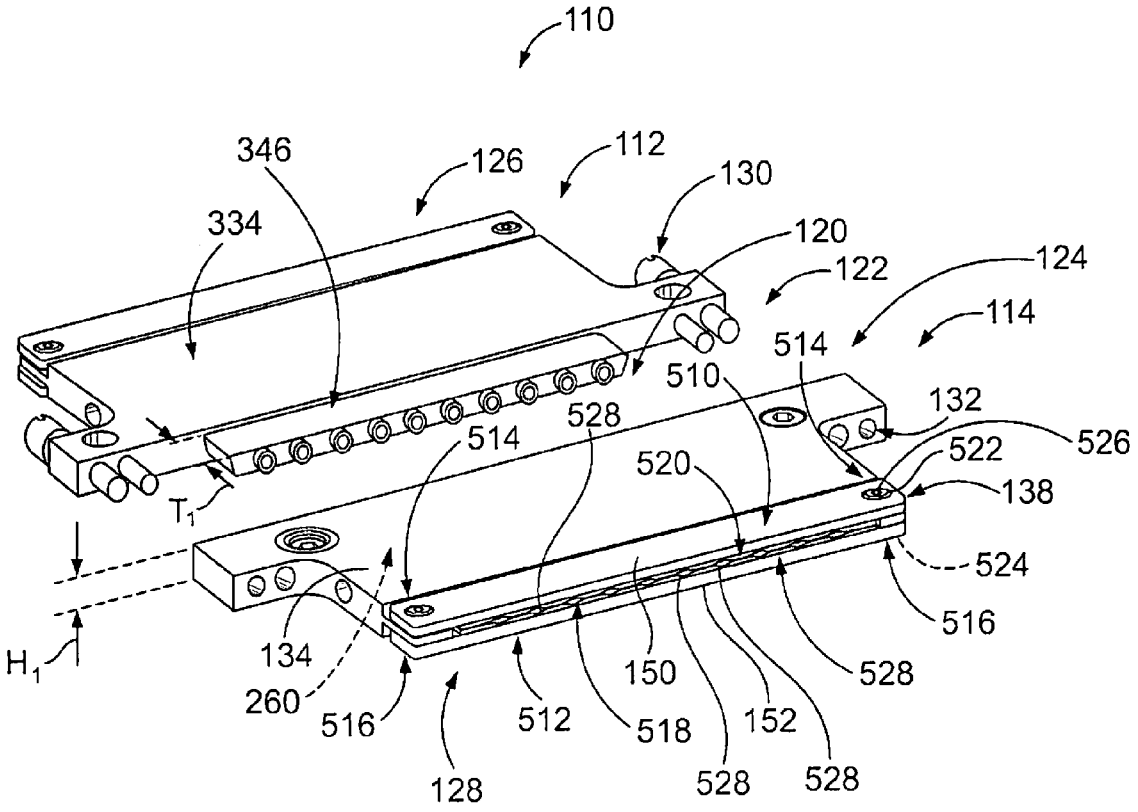
FIG. 6 is an exploded view of an embodiment of another electrical connector system.
Figure 10:
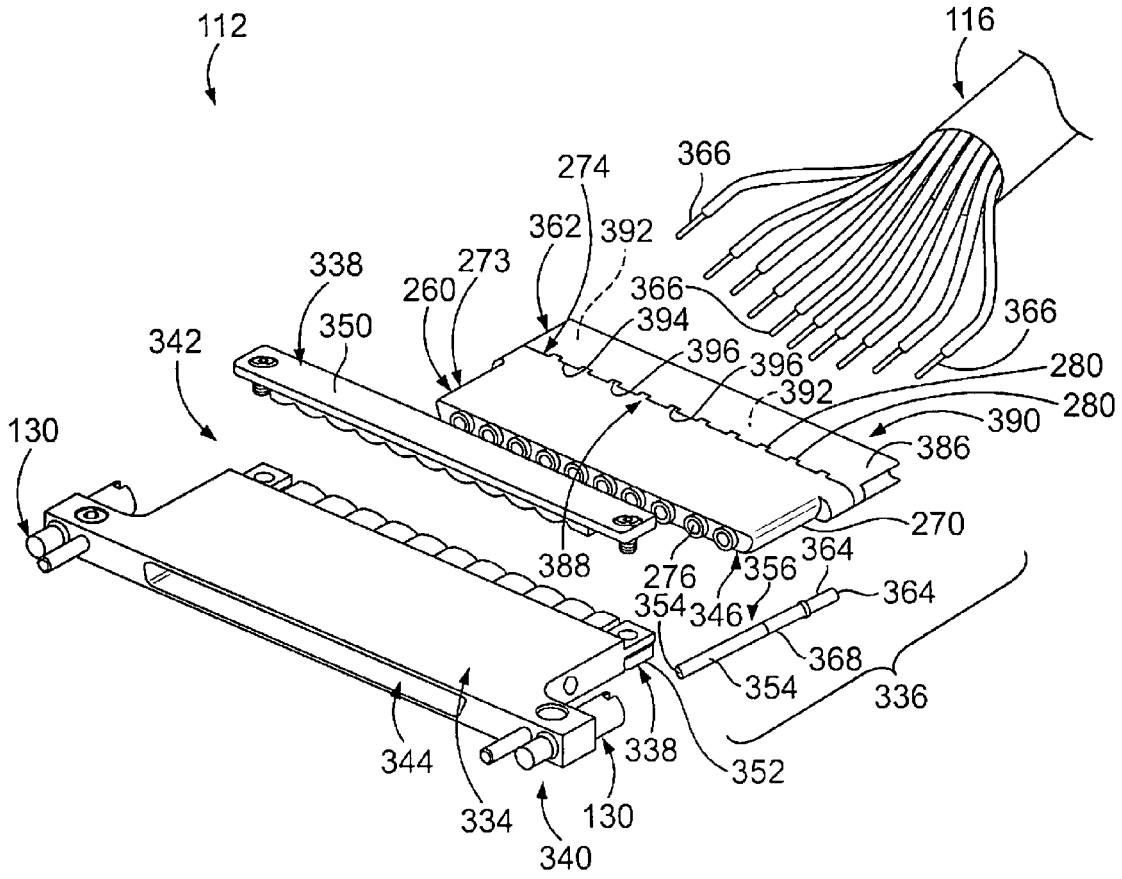
FIG. 10 is a partially exploded perspective detailed view of an embodiment of another electrical connector of the electrical connector system shown in FIG. 6.

The electrical connectors 12 and 14 are configured to be mated together at a separable mating interface 20 to electrically connect the electrical components together. The electrical connectors 12 and 14 may be mated together at the mating interface 20 to transmit power and/or data along the transmission path between the cables 16 and 18, and thus between the electrical components. In the illustrated embodiment, the electrical connector 12 constitutes a plug assembly and the electrical connector 14 constitutes a receptacle assembly that is configured to receive the plug assembly of the electrical connector 12. The electrical connector 12 may also be configured to mate with the electrical connector 114 (FIGS. 6-8), while the electrical connector 14 may also be configured to mate with the electrical connector 112 (FIGS. 6 and 10).

In the illustrated embodiment, the electrical connectors 12 and 14 are low profile connectors that have a generally short and generally wide configuration such that the electrical connectors 12 and 14 have a larger side-to-side dimension as compared to a top-to-bottom dimension. For example, in the illustrated embodiment, the electrical connectors 12 and 14 have a height H that is generally not much taller than a thickness T (e.g., within approximately 200%, within approximately 150%, or within approximately 125% of the thickness T) of a dielectric insert 260 of the connector 14. The low profile aspect of the electrical connectors 12 and 14 is at least partially provided by respective shells 234 and 34 of the electrical connectors 12 and 14 that have the generally short and generally wide configurations that define low profile shells 234 and 34. The low profile aspect of the electrical connectors 12 and 14 may allow the electrical connectors 12 and 14 to be positioned within, and routed through, relatively small spaces. Moreover, the low profile aspect of the electrical connectors 12 and 14 may enable the electrical connectors 12 and/or 14 to be arranged side-by-side in a row with one or more other electrical connectors (not shown) and/or may enable the electrical connectors 12 and/or 14 to be stacked in a column with one or more other electrical connectors (not shown). Optionally, the electrical connector 12 and/or the electrical connector 14 is mounted to a panel (not shown).

The electrical connectors 12 and 14 include respective mating ends 22 and 24 at which the electrical connectors 12 and 14 are configured to be mated together at the mating interface 20. The electrical connectors 12 and 14 include respective termination ends 26 and 28 that are opposite the respective mating ends 22 and 24. The electrical connectors 12 and 14 are terminated to the respective cables 16 and 18 at the respective termination ends 26 and 28. Each of the electrical connectors 12 and 14 may be referred to herein as a "mating connector".

Optionally, the electrical connectors 12 and 14 include respective fasteners 30 and 32 that are configured to secure the electrical connectors 12 and 14 to each other when the electrical connectors 12 and 14 are mated together. In the illustrated embodiment, the fasteners 30 and 32 are threaded fasteners that threadably connect together to secure the electrical connectors 12 and 14 to each other. Specifically, the fasteners 30 are threaded bolts or screws and the fasteners 32 are threaded openings in the illustrated embodiment. But, in addition or alternatively to the threaded fasteners, the electrical connectors 12 and 14 may include any other type of fasteners 30 and 32 for securing the electrical connectors 12 and 14 as mated together, such as, but not limited to, one or more latches and/or the like. Although two are shown, the electrical connector 12 may include any number of the fasteners 30 and the electrical connector 14 may include any number of the fasteners 32. The fasteners 30 and 32 may be alternated between the connectors 12 and 14 such that the electrical connector 12 includes one or more the fasteners 32 and the electrical connector 14 includes one or more of the fasteners 30. The fasteners 30 and 32 may be each be referred to herein as "securing features".

Figure 2:
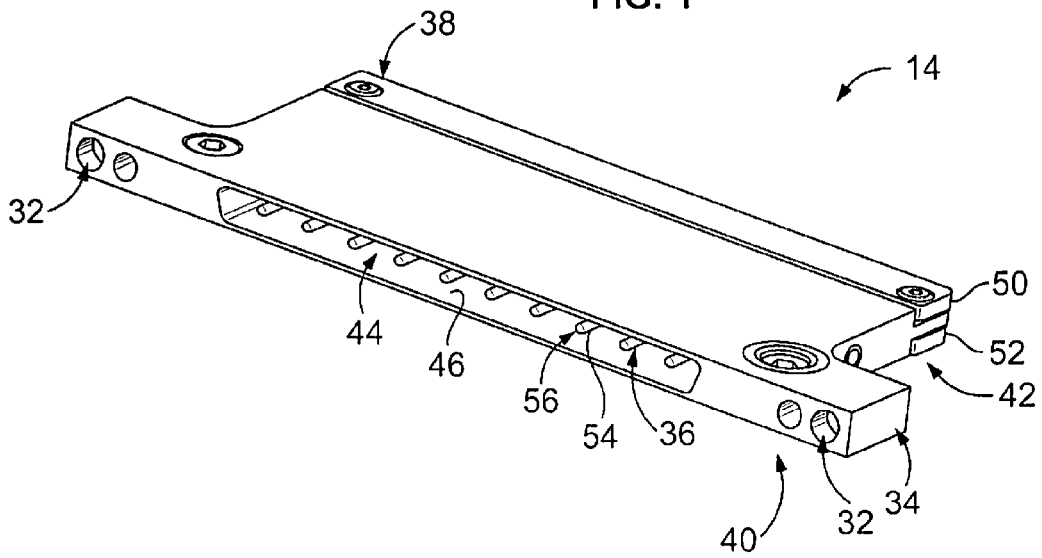
FIG. 2 is a perspective view of an embodiment of an electrical connector of the electrical connector system shown in FIG. 1.
Figure 3:
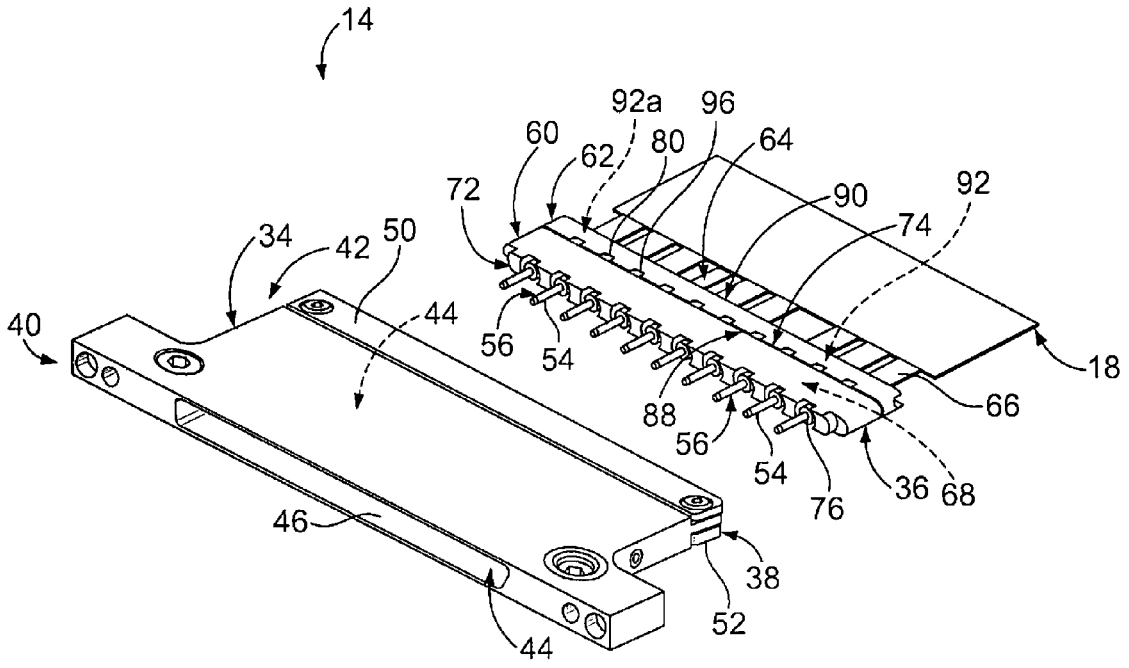
FIG. 3 is an exploded perspective view of the electrical connector shown in FIG. 2.

FIG. 2 is a perspective view of an embodiment of the electrical connector 14 illustrating the electrical connector 14 as unterminated to the cable 18. FIG. 3 is an exploded perspective view of the electrical connector 14 illustrating the terminal subassembly 36 terminated to the cable 18. Referring now to FIGS. 2 and 3, the electrical connector 14 includes a shell 34, a terminal subassembly 36 held by the shell 34, and a cable clamp 38. The shell 34 extends from a mating end 40 to an opposite termination end 42. The shell 34 includes an internal cavity 44 that extends between the mating end 40 and the termination end 42. The terminal subassembly 36 is configured to be held within the cavity 44.

The shell 34 is configured to be mated to the electrical connector 12 (FIGS. 1 and 9) at the mating end 40 of the shell 34. The cavity 44 of the shell 34 includes an entrance at the mating end 40 that defines a receptacle 46 of the shell 34. The receptacle 46 is configured to receive a plug 246 (FIG. 9) of the electrical connector 12 when the electrical connectors 12 and 14 are mated together. In the illustrated embodiment, the fasteners 32 of the electrical connector 14 are provided along the mating end 40 of the shell 34 at opposite sides of the shell 34 to secure the electrical connectors 12 and 14 as mated together. But, the fasteners 32 may additionally or alternatively include any other location along the shell 34.

Optionally, the shell 34 is manufactured from an electrically conductive material (such as, but not limited to, a metal material, a composite material, and/or the like) such that the shell 34 provides electrical shielding around the terminal subassembly 36. The shell 34 may be electrically connected to an electrical shield (not shown) of the cable 18 (FIGS. 1 and 3-5) to facilitate such electrical shielding.

As can be seen in FIGS. 2 and 3, the cable clamp 38 is mounted to the shell 34 at the termination end 42 of the shell 34. The cable clamp 38 includes opposing clamping members 50 and 52 that are configured to clamp the cable 18 therebetween at the termination end 42 of the shell 34. The cable clamp 38 may provide the cable 18 with strain relief.

Referring again to FIG. 1, each of the clamping members 50 and 52 has a unitary body 410 and 412, respectively, that includes both a respective actuation segment 414 and 416 and a respective pressing surface 418 and 420. In some embodiments, the unitary body 410 and/or 412 is fabricated from one or more metals such that the unitary body 410 and/or 412 is a metallic body 410 and/or 412. In other embodiments, the unitary body 410 and/or 412 may be fabricated from one or more plastics such that the unitary body 410 and/or 412 is a plastic body 410 and/or 412. The pressing surfaces 418 and 420 face each other and engage the cable 18 therebetween. The actuation segment 414 and 416 of each clamping member 50 and 52, respectively, is configured to cooperate with the other clamping member to move the pressing surfaces 418 and 420 toward each other. In the illustrated embodiment, the actuation segments 414 and 416 include respective openings 422 and 424 that are configured to receive threaded fasteners 426 to move the pressing surfaces 418 and 420 toward each other. But, other arrangements may be used to move the pressing surfaces 418 and 420 toward each other in addition or alternative to the openings 422 and 424 and/or the threaded fasteners 426.

At least one of the pressing surfaces 418 and 420 has a shape that is complementary with a shape of the cable 18. Specifically, in the illustrated embodiment, both of the pressing surfaces 418 and 420 has an undulating shape 428 that is complementary with the ribbon shape of the ribbon cable 18. The undulating shapes 428 shown herein are exemplary shapes only. The undulating shape 428 of each pressing surface 418 and 420 may have any profile that is complementary with the ribbon shape of the ribbon cable 18.

Optionally, the pressing surface 418 and/or 420 is coated with a silicone rubber material, such as, but not limited to, a one-part silicone rubber material (e.g., RTV-1 available from Wacker Chemie AG of Muchen, Germany), a two-part silicone rubber material (e.g., RTV-2 available from Wacker Chemie AG of Muchen, Germany), RTV 5691 (available from Wacker Chemie AG of Muchen, Germany), and/or the like. The cable clamp 38 does not include a fluorosilicone material that extends along the pressing surface 418 and does not include a fluorosilicone material that extends along the pressing surface 420. For example, neither of the clamping members 50 or 52 includes a discrete fluorosilicone gasket that extends along the pressing surfaces 418 and 420.

Referring again to FIGS. 2 and 3, the terminal subassembly 36 is shown in FIG. 2 as being held within the cavity 44 of the shell 34. The only portions of the terminal subassembly 36 that are visible in FIG. 2 are mating interfaces 54 of terminals 56 of the terminal subassembly 36, which are shown as extending within the receptacle 46 of the shell 34 for mating with corresponding terminals 256 (FIG. 9) of the electrical connector 12.

Referring now solely to FIG. 3, the terminal subassembly 36 includes the terminals 56, a dielectric insert 60, and a dielectric insert 62. The terminals 56 are held by the dielectric inserts 60 and 62. As should be apparent from FIGS. 2 and 3, the dielectric inserts 60 and 62 are held within the cavity 44 of the shell 34. As will be described below, the dielectric insert 60 is a modular insert that is: (1) configured to hold the terminals 56, which include termination interfaces 64 (better seen in FIGS. 4 and 5) that are flat interfaces for terminating the terminals 56 to the cable 18 using a weld, solder, and/or a bond (e.g., an epoxy, an adhesive, and/or the like, whether or not the epoxy, adhesive, and/or the like is electrically conductive); and (2) is also configured to hold terminals (e.g., the terminals 156 shown in FIGS. 7 and 8) that include termination interfaces (e.g., the termination interfaces 164 shown in FIG. 8) that are crimp interfaces for terminating the terminals to a corresponding cable (e.g., the cable 118 shown in FIG. 8) using crimps. In other words, the dielectric insert 60 is configured to be selectively used with both an electrical connector that terminates to a cable using flat interfaces and an electrical connector that terminates to a cable using crimps. The dielectric insert 60 may be referred to herein as a "front" dielectric insert, while the dielectric insert 62 may be referred to herein as a "rear" dielectric insert. As used herein, a "flat interface" may have any shape (e.g., any level of flatness) that enables the flat interface to be terminated to a terminal using a weld, solder, and/or a bond. Accordingly, a "flat interface" may be approximately flat but may additionally or alternatively have some surface contour, undulation, protrusions, depressions, and/or the like.

Figure 4:
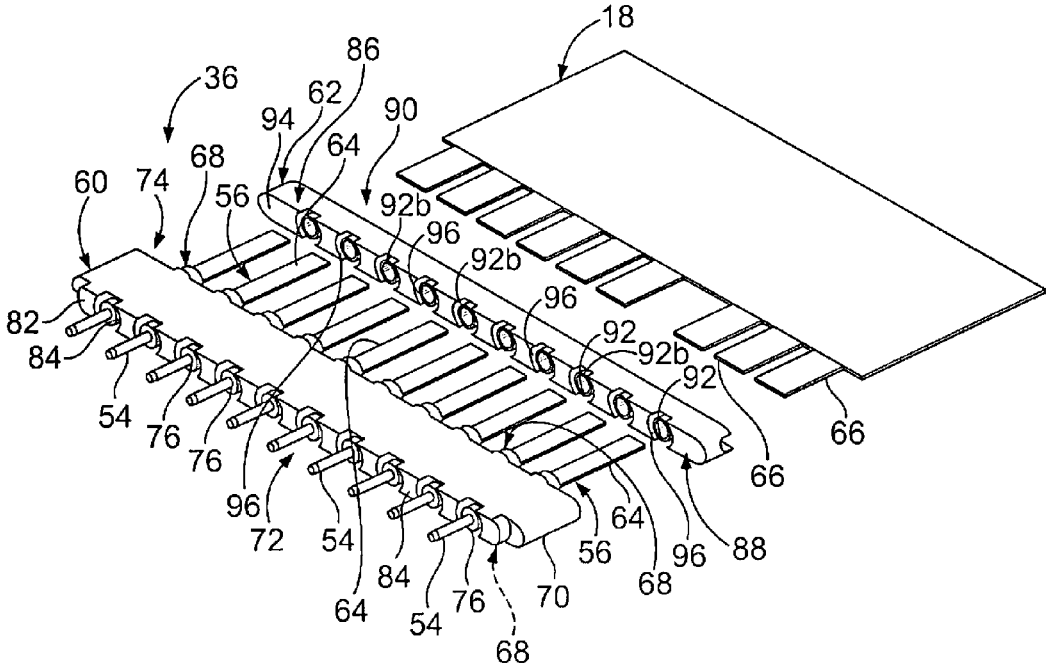
FIG. 4 is an exploded perspective view of an embodiment of a terminal subassembly of the electrical connector shown in FIGS. 2 and 3.
Figure 5:
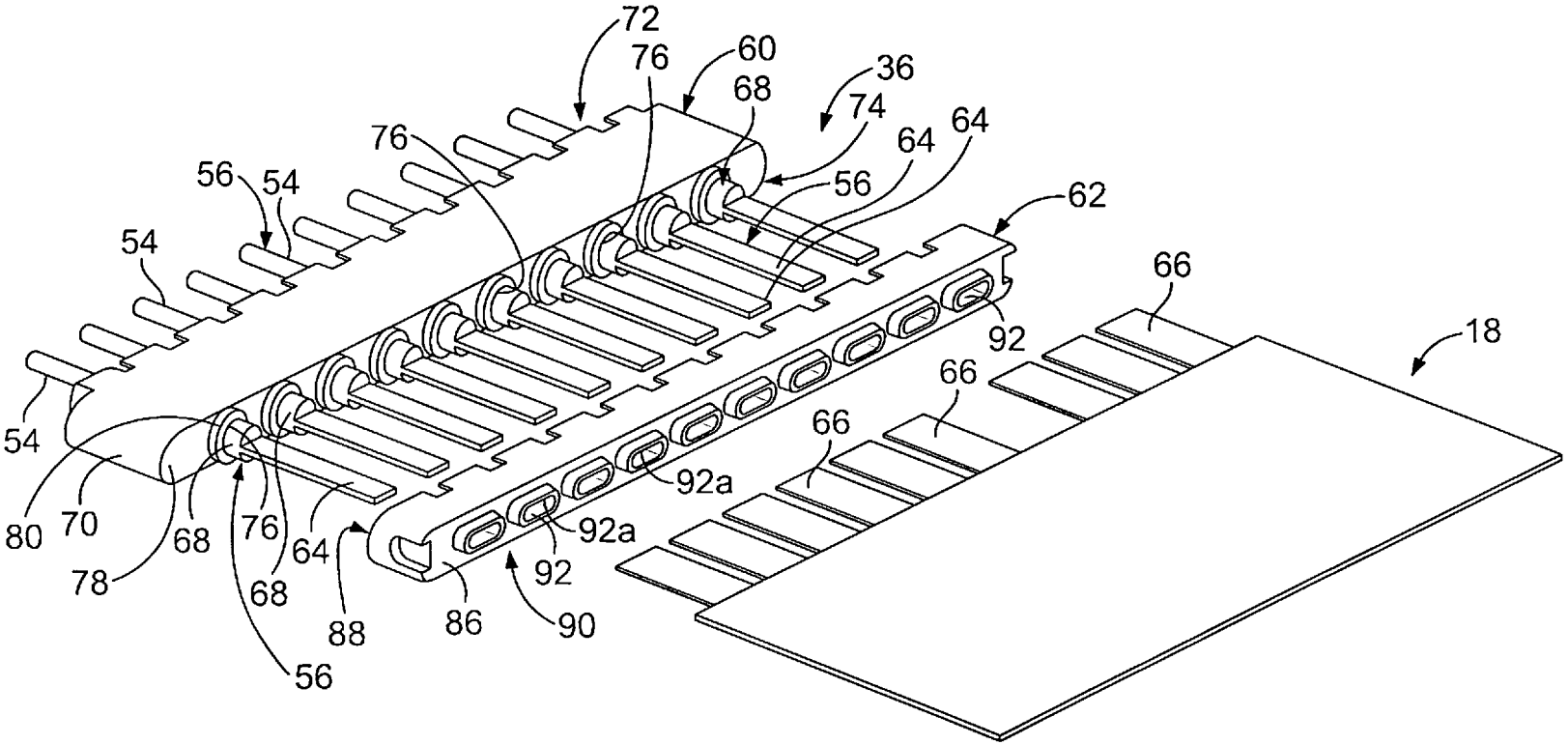
FIG. 5 is another exploded perspective view of the terminal subassembly shown in Figure viewed from a different angle than FIG. 4.

FIGS. 4 and 5 are exploded perspective detailed views of an embodiment of the terminal subassembly 36 of the electrical connector 14. The cable 18 that is terminated by the electrical connector 14 is also shown in FIGS. 4 and 5. Referring now to FIGS. 4 and 5, the terminals 56 include the mating interfaces 54 and the termination interfaces 64. As described above, terminals 56 are configured to mate with the corresponding terminals 256 (FIG. 9) of the electrical connector 12 (FIGS. 1 and 9) at the mating interfaces 56. In the illustrated embodiment, the mating interfaces 54 are pins that are configured to be received within sockets of the corresponding terminals 256 of the electrical connector 12. Alternatively, the mating interfaces 54 can be sockets that are configured to receive pins of the corresponding terminals 256 of the electrical connector 12. In still other embodiments, the mating interfaces 54 of the terminals 56 have another structure, such as, but not limited to, a blade structure, a spring finger structure, and/or the like. The terminals 56 may be copper based electrical terminals or fiberoptic terminals, depending on the particular application. Although ten terminals 56 are shown, the electrical connector 14 may include any number of the terminals 56, such as, but not limited to, eight terminals 56, nine terminals 56, twelve terminals 56, sixteen terminals 56, eighteen terminals 56, or twenty terminals 56.

The terminals 56 are configured to be terminated to corresponding conductors 66 of the cable 18 at the termination interfaces 64. In the illustrated embodiment, the cable 18 is a ribbon (e.g., approximately flat) cable having the generally shape of a ribbon. The cable 18 includes the conductors 66, which in the illustrated embodiment of the ribbon cable 18 have an approximately flat (i.e., planar) shape. In the illustrated embodiment, the termination interfaces 64 of the terminals 56 are flat interfaces that are configured to be terminated to the corresponding conductors 66 using a weld, solder, and/or a bond. Although nine are shown, the cable 18 may include any number of the conductors 66. Optionally, the termination interfaces 64 of two of the terminals 56 are terminated to a single conductor 66.

The terminals 56 include intermediate segments 68 that extend between, and interconnect, the mating interfaces 54 and the termination interfaces 64. In the illustrated embodiment, and as best seen in FIG. 5, the intermediate segments 68 have a cylindrical shape. But, the intermediate segments 68 of the terminals 56 may alternatively include any other shape.

The dielectric insert 60 includes a body 70 that extends from a front face 72 to an opposite rear face 74. The body 70 of the dielectric insert 60 is manufactured from a dielectric material.

The body 70 of the dielectric insert 60 includes terminal channels 76 that extend through the body 70. As discussed above, the dielectric inserts 60 and 62 are configured to hold the terminals 56. Specifically, each terminal channel 76 is configured to hold the intermediate segment 68 of a corresponding terminal 56. As can be seen in FIGS. 4 and 5, the mating interfaces 54 of the terminals 56 extend outward from the front face 72 of the dielectric insert 60 when the intermediate segments 68 are held by the dielectric insert 60 within the terminal channels 76. Optionally, one or more of the terminals channels 76 does not hold a terminal 56 therein such that the terminal channel 76 is "blanked out".

Each terminal channel 76 has a complementary shape relative to the intermediate segment 68 of the corresponding terminal 56. In the illustrated embodiment, the terminal channels 76 have cylindrical shapes that are complementary with the cylindrical shapes of the exemplary intermediate segments 68. But, the terminal channels 76 may additionally or alternatively include any other shape, for example in embodiments wherein the intermediate segments 68 include other shapes than the cylindrical shapes shown herein. Each terminal channel 76 is configured to receive the intermediate segment 68 of the corresponding terminal 56 therein such that the dielectric insert 60 securely holds the terminal 56. The terminal channels 76 may receive the corresponding intermediate segments 68 with any type of connection, structure, means, and/or the like that enables the terminal channels 76 to securely hold the corresponding intermediate segments 68. In the illustrated embodiment, each of the terminal channels 76 receives the intermediate segment 68 of the corresponding terminal 56 with an interference fit to securely hold the intermediate segment 68. But, in addition or alternative to the interference fit, each terminal channel 76 may receive the intermediate segment 68 with any other type of connection, structure, means, and/or the like, such as, but not limited to, using a snap-fit, using an adhesive, and/or the like.

Referring now solely to FIG. 5, the rear face 74 of the dielectric insert 60 includes a base surface 78 and towers 80 that extend outward from the base surface 78. As will be described below, the towers 80 are configured to nest within recesses 96 (FIG. 4) of the dielectric insert 62, for example to facilitate sealing (e.g., environmental sealing, electrical sealing, and/or the like) the rear face 74 of the dielectric insert 60 with a front face 88 of the dielectric insert 62 and/or to facilitate alignment of the rear face 74 and the front face 88. The shape of each tower 80 is complementary with the shape of the corresponding recess 96. Although shown as having a cylindrical shape, the towers 80 may additionally or alternatively include any other shape, such as, but not limited to, a rectangular shape, a parallelepiped shape, a triangular shape, an oval shape, a square shape, and/or the like. As used herein, "environmental sealing" of an interface between two components is a mechanical seal at the interface that prevents environmental conditions and substances (e.g., moisture, dirt, dust, debris, and/or the like) from moving through the interface. As used herein, "electrical sealing" of an interface between two components refers to blocking a line-of-sight path between adjacent pairs of mated terminals, which may prevent electrical arching and/or other electrical interference between the adjacent pairs of mated terminals.

Referring now solely to FIG. 4, the front face 72 of the dielectric insert 60 includes a base surface 82 and recesses 84 that extend into the base surface 82. As will be described below, the recesses 84 are configured to receive towers 284 (FIG. 9) of a dielectric insert 260 (FIGS. 1, 9, and 10) of the electrical connector 12 therein when the electrical connectors 12 and 14 are mated together. The shape of each recess 84 is complementary with the shape of the corresponding tower 284. Although shown as having a cylindrical shape, the recesses 84 may additionally or alternatively include any other shape, such as, but not limited to, a rectangular shape, a parallelepiped shape, a triangular shape, an oval shape, a square shape, and/or the like.

The recesses 84, the terminal channels 76, and the base surface 82 are integrally formed with at least a portion of the body 70 of the dielectric insert 60 such that the dielectric insert 60 includes a unitary body 70 that includes the recesses 84, the terminal channels 76, and the base surface 82. The unitary body 70 may be fabricated using any process, such as, but not limited to, a molding process, a casting process, and/or the like. In some embodiments, the unitary body 70 is fabricated using a molding process such that the recesses 84 are molded recesses 84.

Referring again to FIGS. 4 and 5, the dielectric insert 62 includes a body 86 that extends from the front face 88 to an opposite rear face 90. The body 86 of the dielectric insert 62 is manufactured from a dielectric material.

The body 86 of the dielectric insert 62 includes terminal channels 92 that extend through the body 86. Each terminal channel 92 is configured to hold the termination interface 64 of a corresponding terminal 56. As should be apparent from FIGS. 4 and 5, the termination interfaces 64 of the terminals 56 extend outward from the rear face 90 of the dielectric insert 62 when the termination interfaces 64 are held by the dielectric insert 62 within the terminal channels 92.

Referring now solely to FIG. 5, each terminal channel 92 has a complementary shape relative to the termination interface 64 of the corresponding terminal 56. In the illustrated embodiment, the terminal channels 92 include segments 92*a* that extend through the rear face 90 and have generally parallelepiped shapes that are complementary with the approximately flat shapes of the exemplary termination interfaces 64. But, the segments 92*a* of the terminal channels 92 may additionally or alternatively include any other shape, for example in embodiments wherein the cable segments 64 include other shapes than the approximately flat shapes shown herein. The segments 92*a* of the terminal channels 92 may receive the corresponding termination interfaces 64 with any type of connection, structure, means, and/or the like, such as, but not limited to, with a loose (i.e., floating) fit, with an interference fit, using a snap-fit, using an adhesive, and/or the like.

Optionally, each terminal channel 92 is also configured to hold a portion of the intermediate segment 68 of the corresponding terminal 56. For example, and referring now solely to FIG. 4, in the illustrated embodiment the terminal channels 92 include segments 92*b* that extend through the front face 88 and have generally cylindrical shapes that are complementary with the cylindrical shapes of the intermediate segments 68. The segments 92*b* of the terminal channels 92 may receive the corresponding intermediate segments 68 with any type of connection, structure, means, and/or the like, such as, but not limited to, with a loose (i.e., floating) fit, with an interference fit, using a snap-fit, using an adhesive, and/or the like.

The front face 88 of the dielectric insert 62 includes a base surface 94 and the recesses 96, which extend into the base surface 94. As described above, the recesses 96 are configured receive the towers 80 of the dielectric insert 60, for example to facilitate sealing (e.g., environmental sealing, electrical sealing, and/or the like) the rear face 74 of the dielectric insert 60 with the front face 88 of the dielectric insert 62 and/or to facilitate alignment of the rear face 74 and the front face 88. The shape of each recess 96 is complementary with the shape of the corresponding tower 80. Although shown as having a cylindrical shape, the recesses 96 may additionally or alternatively include any other shape, such as, but not limited to, a rectangular shape, a parallelepiped shape, a triangular shape, an oval shape, a square shape, and/or the like.

Referring again to FIG. 3, the terminal subassembly 36 is shown as assembled (i.e., in the unexploded state). The terminals 56 are held by the dielectric inserts 60 and 62. The intermediate segments 68 of the terminals 56 are held within the terminal channels 76 of the dielectric insert 60. As can be seen in FIG. 3, the mating interfaces 54 of the terminals 56 extend outward from the front face 72 of the dielectric insert 60. The termination interfaces 64 are held within the segments 92*a* of the terminal channels 92 of the dielectric insert 62. As can be seen in FIG. 3, the termination interfaces 64 of the terminals 56 extend outward from the rear face 90 of the dielectric insert 62. The termination interfaces 64 of the terminals 56 are terminated to the conductors 66 of the cable 18. Specifically, the termination interfaces 64 are terminated to the corresponding conductors 66 using welds, solder, and/or bonds such that the terminals 56 are electrically or optically connected to the corresponding conductors 66. Only one termination interface 64 is visible in FIG. 3.

As can be seen in FIG. 3, the dielectric inserts 60 and 62 are engaged together in the assembled state of the terminal assembly 36. Specifically, the towers 80 of the dielectric insert 60 are received into (i.e., nested) within corresponding recesses 96 of the dielectric insert 62. The nesting of the towers 80 within the recesses 96 may facilitate sealing (e.g., environmental sealing, electrical sealing, and/or the like) the rear face 74 of the dielectric insert 60 with the front face 88 of the dielectric insert 62 and/or may facilitate alignment of the rear face 74 and the front face 88 during assembly of the terminal subassembly 36. Optionally, the rear face 74 of the dielectric insert 60 and the front face 88 of the dielectric insert 62 are bonded together, such as, but not limited to, using an adhesive, an epoxy, and/or the like.

As described above, the dielectric insert 60 is a modular insert that is: (1) configured to hold terminals having termination interfaces that are flat interfaces that are configured to be terminated to the conductors of a cable using a weld, solder, and/or a bond (e.g. the terminals 56 having the termination interfaces 64); and (2) is also configured to hold terminals having termination interfaces that are that are crimp interfaces for terminating the terminals to the conductors of a cable using crimps. In other words, the dielectric insert 60 is configured to be selectively used with both an electrical connector that terminates to a cable using welds, solder, and/or bonds and an electrical connector that terminates to a cable using crimps.

Figure 8:
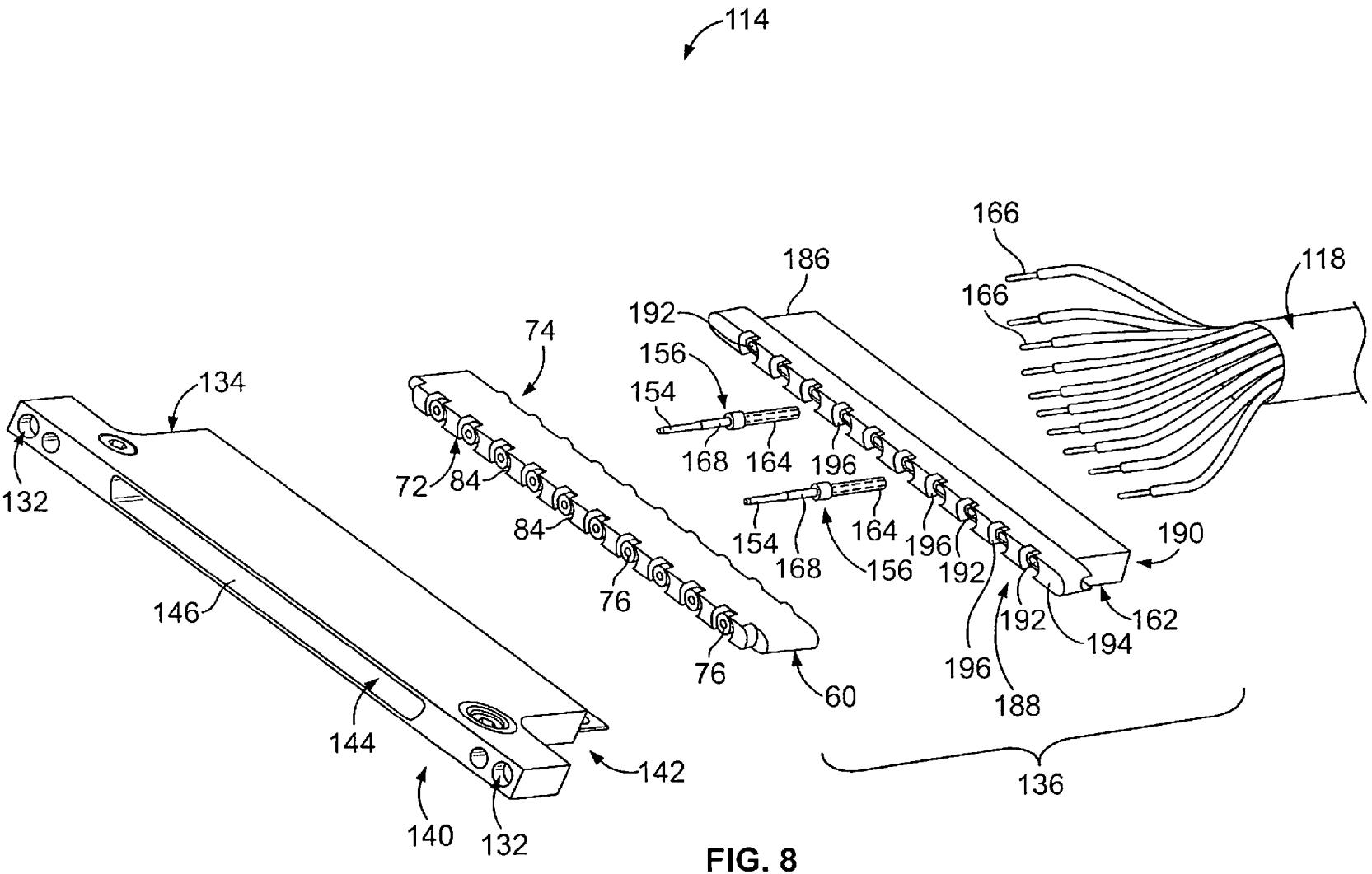
FIG. 8 is an exploded perspective detailed view of the electrical connector shown in FIG. 7.
Figure 9:
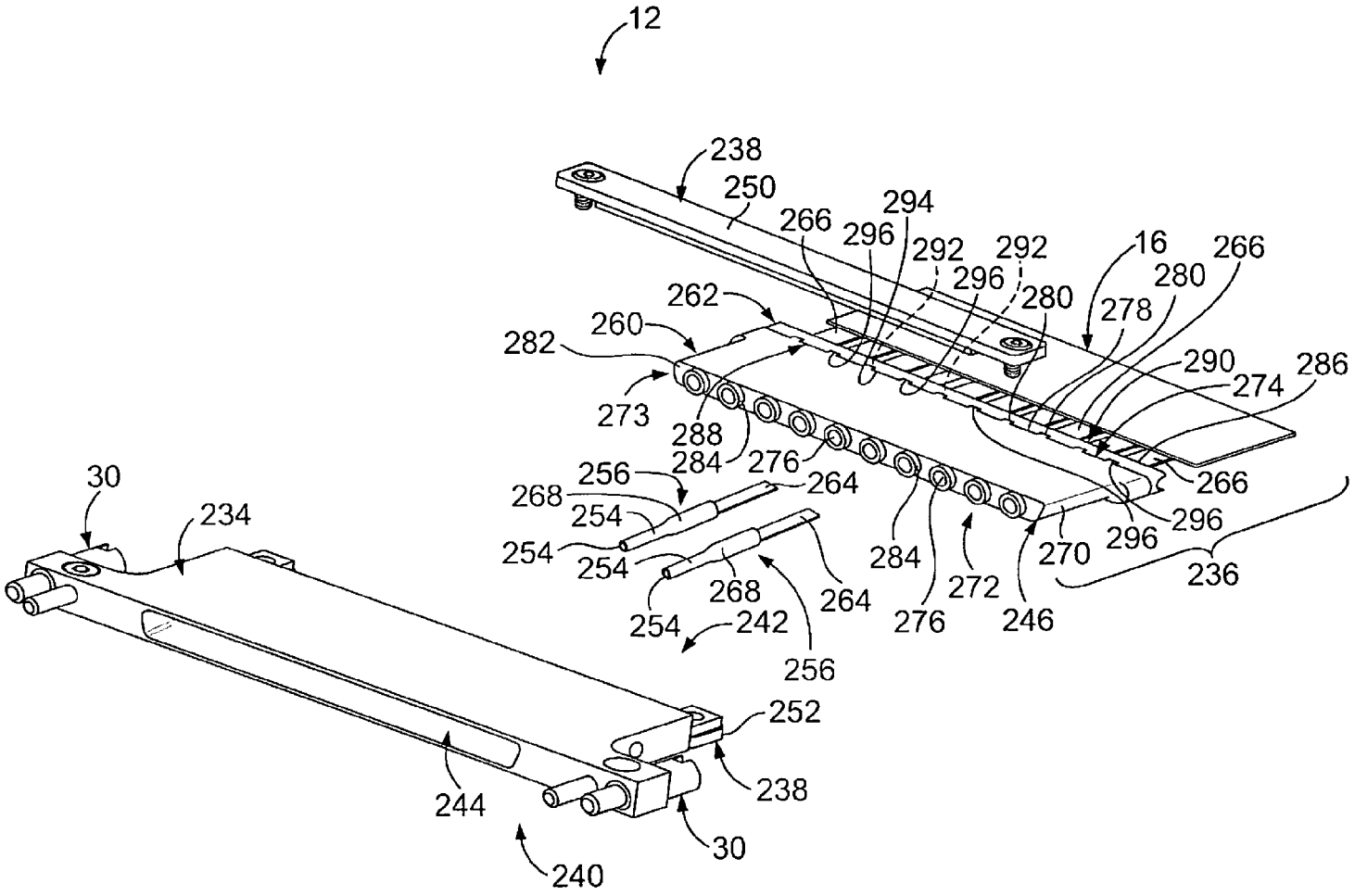
FIG. 9 is a partially exploded perspective view of an embodiment of another electrical connector of the electrical connector system shown in FIG. 1.

For example, FIG. 6 is a partially exploded perspective view of an embodiment of an electrical connector system 110 having electrical connectors 112 and 114 that are configured to be mated together and that each terminate to respective cables 116 (FIG. 10) and 118 (FIG. 8) using crimps. As will be described below, the electrical connector 114 includes the dielectric insert 60 (FIGS. 3-5). The cables 116 and 118 are terminated to corresponding electrical components (not shown). Each of the electrical components may be any type of electrical component. In some embodiments, one or more of the electrical components is an electrical component of a PV system, such that the electrical connector system 110 is a PV connector system. Examples of electrical components of PV systems include, but are not limited to, PV modules or arrays that are used to generate electricity (e.g., solar panels and/or the like), and/or other PV components used within a PV system (e.g., power storage devices, sensors, controllers, and/or the like). In some embodiments, the electrical components are components of a PV and/or other system that is configured to operate in outer space, that is configured to operate in orbit of the earth, and/or that is located on-board a satellite. Accordingly, in some embodiments, the electrical connector system 110 is configured to operate in outer space, is configured to operate in orbit around the earth, and/or is located on-board a satellite. The electrical connector 112 may also be configured to mate with the electrical connector 14 (FIGS. 1-3), while the electrical connector 114 may also be configured to mate with the electrical connector 12 (FIGS. 1 and 9).

The electrical connectors 112 and 114 are configured to be mated together at a separable mating interface 120 to electrically connect the electrical components together. The electrical connectors 112 and 114 may be mated together at the mating interface 120 to transmit power and/or data along the transmission path between the cables 116 and 118, and thus between the electrical components. In the illustrated embodiment, the electrical connector 112 constitutes a plug assembly and the electrical connector 114 constitutes a receptacle assembly that is configured to receive the plug assembly of the electrical connector 112. Each of the electrical connector 112 and the electrical connector 114 may be referred to herein as a "mating connector".

In the illustrated embodiment, the electrical connectors 112 and 114 are low profile connectors that have a generally short and generally wide configuration such that the electrical connectors 112 and 114 have a larger side-to-side dimension as compared to a top-to-bottom dimension. For example, in the illustrated embodiment, the electrical connectors 112 and 114 have a height $H_1$ that is generally not much taller than a thickness $T_1$ of a dielectric insert 260 of the electrical connector 114. For example, the height $H_1$ of each of the electrical connectors 112 and 114 may be within approximately 200%, within approximately 150%, or within approximately 125% of the thickness $T_1$. The low profile aspect of the electrical connectors 112 and 114 is at least partially provided by respective shells 334 and 134 of the electrical connectors 112 and 114 that have the generally short and generally wide configurations that define low profile shells 334 and 134. The low profile aspect of the electrical connectors 112 and 114 may allow the electrical connectors 112 and 114 to be positioned within, and routed through, relatively small spaces. Moreover, the low profile aspect of the electrical connectors 112 and 114 may enable the electrical connectors 112 and/or 114 to be arranged side-by-side in a row with one or more other electrical connectors (not shown) and/or may enable the electrical connectors 112 and/or 114 to be stacked in a column with one or more other electrical connectors (not shown). Optionally, the electrical connector 112 and/or the electrical connector 114 is mounted to a panel (not shown).

The electrical connectors 112 and 114 include respective mating ends 122 and 124 at which the electrical connectors 112 and 114 are configured to be mated together at the mating interface 120. The electrical connectors 112 and 114 include respective termination ends 126 and 128 that are opposite the respective mating ends 122 and 124. The electrical connectors 112 and 114 are terminated to the respective cables 116 and 118 at the respective termination ends 126 and 128.

Optionally, the electrical connectors 112 and 114 include respective fasteners 130 and 132 that are configured to secure the electrical connectors 112 and 114 to each other. In the illustrated embodiment, the fasteners 130 and 132 are threaded fasteners that threadably connect together to secure the electrical connectors 112 and 114 to each other. Specifically, the fasteners 130 are threaded bolts or screws and the fasteners 132 are threaded openings in the illustrated embodiment. But, in addition or alternatively to the threaded fasteners, the electrical connectors 112 and 114 may include any other type of fasteners 130 and 132 for securing the electrical connectors 112 and 114 as mated together, such as, but not limited to, one or more latches and/or the like. Although two are shown, the electrical connector 112 may include any number of the fasteners 130 and the electrical connector 114 may include any number of the fasteners 132. The fasteners 130 and 132 may be alternated between the connectors 112 and 114 such that the electrical connector 112 includes one or more the fasteners 132 and the electrical connector 114 includes one or more of the fasteners 130. The fasteners 130 and 132 may be each be referred to herein as "securing features".

Figure 7:
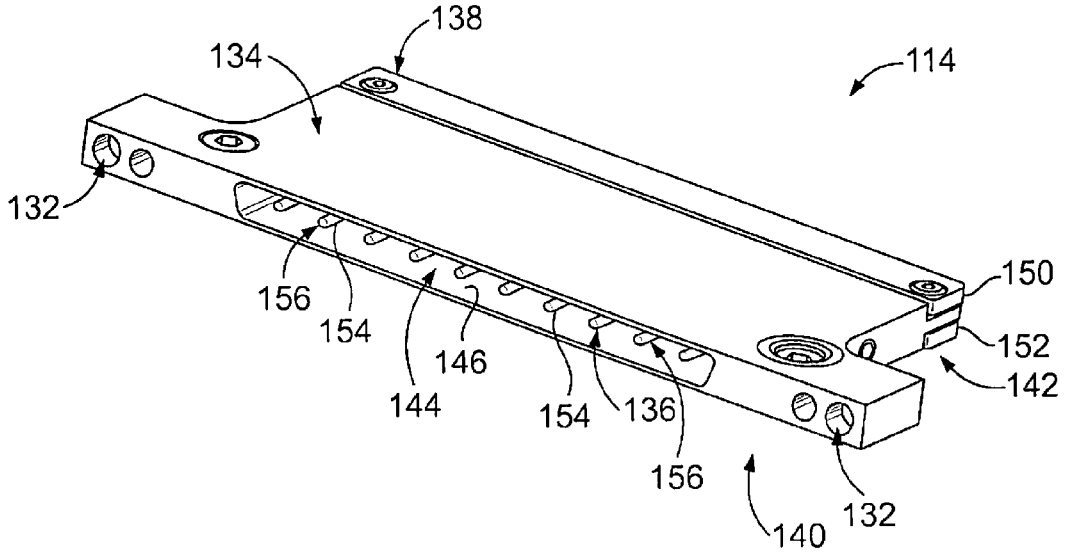
FIG. 7 is a perspective view of an embodiment of an electrical connector of the electrical connector system shown in FIG. 1.

FIG. 7 is a perspective view of an embodiment of the electrical connector 114 illustrating the electrical connector 114 as unterminated to the cable 118. FIG. 8 is an exploded perspective view of the electrical connector 114. The cable 118 is not shown in FIG. 7. Referring now to FIGS. 7 and 8, the electrical connector 114 includes the dielectric insert 60 (not visible in FIG. 7) and terminates to the cable 118 using crimps, as discussed above. The electrical connector 114 includes a shell 134, a terminal subassembly 136 held by the shell 134, and a cable clamp 138. The cable clamp 138 is not shown in FIG. 8. The shell 134 extends from a mating end 140 to an opposite termination end 142. The shell 134 includes an internal cavity 144 that extends between the mating end 140 and the termination end 142. The terminal subassembly 136 is configured to be held within the cavity 144.

The shell 134 is configured to be mated to the electrical connector 112 (FIGS. 6 and 10) at the mating end 140 of the shell 134. In the illustrated embodiment, the cavity 144 of the shell 134 includes an entrance at the mating end 140 that defines a receptacle 146 of the shell 134, which is configured to receive a plug 346 (FIGS. 6 and 10) of the electrical connector 112 when the electrical connectors 114 and 112 are mated together. In the illustrated embodiment, the fasteners 132 of the electrical connector 114 are provided along the mating end 140 of the shell 134 at opposite sides of the shell 134 to secure the electrical connectors 112 and 114 as mated together. But, the fasteners 132 may additionally or alternatively include any other location along the shell 134.

Optionally, the shell 134 is manufactured from an electrically conductive material (such as, but not limited to, a metal material, a composite material, and/or the like) such that the shell 134 provides electrical shielding around the terminal subassembly 136. The shell 134 may be electrically connected to an electrical shield (not shown) of the cable 118 to facilitate such electrical shielding.

The cable clamp 138 is mounted to the shell 134 at the termination end 142 and includes opposing clamping members 150 and 152 that are configured to clamp the cable 118 therebetween at the termination end 142 of the shell 134. The cable clamp 138 may provide the cable 118 with strain relief.

Referring again to FIG. 6, each of the clamping members 150 and 152 has a unitary body 510 and 512, respectively, that includes both a respective actuation segment 514 and 516 and a respective pressing surface 518 and 520. In some embodiments, the unitary body 510 and/or 512 is fabricated from one or more metals such that the unitary body 510 and/or 512 is a metallic body 510 and/or 512. In other embodiments, the unitary body 510 and/or 512 may be fabricated from one or more plastics such that the unitary body 510 and/or 512 is a plastic body 510 and/or 512. The pressing surfaces 518 and 520 face each other and engage the cable 118 (FIG. 8) therebetween. The actuation segment 514 and 516 of each clamping member 150 and 152, respectively, is configured to cooperate with the other clamping member to move the pressing surfaces 518 and 520 toward each other. In the illustrated embodiment, the actuation segments 514 and 516 include respective openings 522 and 524 that are configured to receive threaded fasteners 526 to move the pressing surfaces 518 and 520 toward each other. But, other arrangements may be used to move the pressing surfaces 518 and 520 toward each other in addition or alternative to the openings 522 and 524 and/or the threaded fasteners 526.

At least one of the pressing surfaces 518 and 520 has a shape that is complementary with a shape of the cable 118. Specifically, in the illustrated embodiment, both of the pressing surfaces 518 and 520 includes a plurality of partially cylindrical (e.g., half or ⅓ cylinders) channels 528 that are complementary with the cylindrical shapes of the cylindrical conductors 166 (FIG. 8) of the cylindrical cable 118. The partially cylindrical channels 528 shown herein are exemplary shapes only. The channels 528 may have any profile that is complementary with the cylindrical shapes of the cylindrical conductors 166.

Optionally, the pressing surface 518 and/or 520 is coated with a silicone rubber material, such as, but not limited to, a one-part silicone rubber material (e.g., RTV-1 available from Wacker Chemie AG of Muchen, Germany), a two-part silicone rubber material (e.g., RTV-2 available from Wacker Chemie AG of Muchen, Germany), RTV S691 (available from Wacker Chemie AG of Muchen, Germany), and/or the like. The cable clamp 138 does not include a fluorosilicone material that extends along the pressing surface 518 and does not include a fluorosilicone material that extends along the pressing surface 520. For example, neither of the clamping members 150 or 152 includes a discrete fluorosilicone gasket that extends along the pressing surfaces 518 and 520.

Referring again to FIGS. 7 and 8, the terminal subassembly 136 is shown in FIG. 7 as being held within the cavity 144 of the shell 134. The only portions of the terminal subassembly 136 that are visible in FIG. 7 are mating interfaces 154 of terminals 156 of the terminal subassembly 136, which are shown in FIG. 7 as extending within the receptacle 146 of the shell 134 for mating with corresponding terminals 356 (FIG. 10) of the electrical connector 112.

Referring now solely to FIG. 8, the terminal subassembly 136 includes the terminals 156, the dielectric insert 60, and a dielectric insert 162. The terminals 156 are held by the dielectric inserts 60 and 162. As should be apparent from FIGS. 7 and 8, the dielectric inserts 60 and 162 are held within the cavity 144 of the shell 134. The dielectric insert 162 may be referred to herein as a "rear" dielectric insert.

The terminals 156 include the mating interfaces 154 and termination interfaces 164. In the illustrated embodiment, the mating interfaces 154 are pins that are configured to be received within sockets of the corresponding terminals 356 of the electrical connector 112. Alternatively, the mating interfaces 154 can be sockets that are configured to receive pins of the corresponding terminals 356 of the electrical connector 112. In still other embodiments, the mating interfaces 154 of the terminals 156 have another structure, such as, but not limited to, a blade structure, a spring finger structure, and/or the like. The terminals 156 may be copper based electrical terminals or fiberoptic terminals, depending on the particular application. In the illustrated embodiment, the electrical connector 114 includes ten terminals 156, although only two are shown in FIG. 8 for clarity. But, the electrical connector 114 may include any number of the terminals 156, such as, but not limited to, eight terminals 156, nine terminals 156, twelve terminals 156, sixteen terminals 156, eighteen terminals 156, or twenty terminals 156.

The terminals 156 are configured to be terminated to corresponding conductors 166 of the cable 118 at the termination interfaces 164. In the illustrated embodiment, the cable 118 is a cylindrical cable having cylindrical shape. The cable 118 includes the conductors 166, which in the illustrated embodiment of the cable 118 have cylindrical shapes. The termination interfaces 164 of the terminals 156 are crimp interfaces that are configured to be terminated to the corresponding conductors 166 using crimps. Specifically, the illustrated embodiment, the termination interfaces 164 are crimp barrels that are configured to receive and be crimped around the corresponding conductor 166. In addition or alternatively to the crimp barrels, the termination interfaces 164 may have any other structure that enables the termination interfaces 164 to be crimped to the conductors 166. Although ten are shown, the cable 118 may include any number of the conductors 166.

The terminals 156 include intermediate segments 168 that extend between, and interconnect, the mating interfaces 154 and the termination interfaces 164. In the illustrated embodiment, the intermediate segments 168 have a cylindrical shape. But, the intermediate segments 168 of the terminals 156 may alternatively include any other shape.

As discussed above, the dielectric inserts 60 and 162 are configured to hold the terminals 156. Specifically, each terminal channel 76 of the dielectric insert 60 is configured to hold the intermediate segment 168 of a corresponding terminal 156. The mating interfaces 154 of the terminals 156 extend outward from the front face 72 of the dielectric insert 60 when the intermediate segments 168 are held by the dielectric insert 60 within the terminal channels 76. Optionally, one or more of the terminals channels 76 does not hold a terminal 156 therein such that the terminal channel 76 is "blanked out".

Each terminal channel 76 has a complementary shape relative to the intermediate segment 168 of the corresponding terminal 156. In the illustrated embodiment, the terminal channels 76 have cylindrical shapes that are complementary with the cylindrical shapes of the exemplary intermediate segments 168. But, the terminal channels 76 may additionally or alternatively include any other shape, for example in embodiments wherein the intermediate segments 168 include other shapes than the cylindrical shapes shown herein. Each terminal channel 76 is configured to receive the intermediate segment 168 of the corresponding terminal 156 therein such that the dielectric insert 60 securely holds the terminal 156. The terminal channels 76 may receive the corresponding intermediate segments 168 with any type of connection, structure, means, and/or the like that enables the terminal channels 76 to securely hold the corresponding intermediate segments 168. In the illustrated embodiment, each of the terminal channels 76 receives the intermediate segment 168 of the corresponding terminal 156 with an interference fit to securely hold the intermediate segment 168. But, in addition or alternative to the interference fit, each terminal channel 76 may receive the intermediate segment 168 with any other type of connection, structure, means, and/or the like, such as, but not limited to, using a snap-fit, using an adhesive, and/or the like.

The recesses 84 of the dielectric insert 60 are configured to receive the towers 284 (FIG. 9) of the dielectric insert 260 (FIGS. 1, 9, and 10) of the electrical connector 112 (FIGS. 6 and 10) therein when the electrical connectors 112 and 114 are mated together. In other words, the front face 72 of the dielectric insert 60 is configured to mate with the front face 272 of the dielectric insert 260 as the electrical connectors 112 and 114 mate together such that the towers 284 nest within corresponding recesses 84. The reception of the towers 284 of the dielectric insert 260 within the recesses 84 of the dielectric insert 60 may facilitate electrically sealing the dielectric inserts 260 and 60 by blocking a line-of-sight path between adjacent pairs of mated terminals 156 and 356, which may prevent electrical arching and/or other electrical interference between adjacent pairs of mated terminals 156 and 356.

The dielectric insert 162 includes a body 186 that extends from a front face 188 to an opposite rear face 190. The body 186 of the dielectric insert 162 is manufactured from a dielectric material. Optionally, at least a portion of the body 186 of the dielectric insert 162 is metalized and/or has a metal shield surrounding such portion to provide electrical shielding for the terminals 156.

The body 186 of the dielectric insert 162 includes terminal channels 192 that extend through the body 186. Each terminal channel 192 is configured to hold the termination interface 164 of a corresponding terminal 156. The termination interfaces 164 of the terminals 156 may or may not extend outward from the rear face 190 of the dielectric insert 162 when the termination interfaces 164 are held by the dielectric insert 162 within the terminal channels 192.

Each terminal channel 192 has a complementary shape relative to the termination interface 164 of the corresponding terminal 156. In the illustrated embodiment, the terminal channels 192 have generally cylindrical shapes that are complementary with the cylindrical shapes of the exemplary termination interfaces 164. But, the terminal channels 192 may additionally or alternatively include any other shape, for example in embodiments wherein the cable segments 164 include other shapes than the approximately flat shapes shown herein. The terminal channels 192 may receive the corresponding termination interfaces 164 with any type of connection, structure, means, and/or the like, such as, but not limited to, with a loose (i.e., floating) fit, with an interference fit, using a snap-fit, using an adhesive, and/or the like.

The front face 188 of the dielectric insert 162 includes a base surface 194 and recesses 196, which extend into the base surface 194. The recesses 196 are configured receive the towers 80 of the dielectric insert 60, for example to facilitate sealing (e.g., environmental sealing, electrical sealing, and/or the like) the rear face 74 of the dielectric insert 60 with the front face 188 of the dielectric insert 162 and/or to facilitate alignment of the rear face 74 and the front face 188. The shape of each recess 196 is complementary with the shape of the corresponding tower 80. Although shown as having a cylindrical shape, the recesses 196 may additionally or alternatively include any other shape, such as, but not limited to, a rectangular shape, a parallelepiped shape, a triangular shape, an oval shape, a square shape, and/or the like.

When the terminal subassembly 136 is assembled and held by the shell 134, the terminals 156 are held by the dielectric inserts 60 and 162. The intermediate segments 168 of the terminals 156 are held within the terminal channels 76 of the dielectric insert 60. The mating interfaces 154 of the terminals 156 extend outward from the front face 72 of the dielectric insert 60. The termination interfaces 164 are held within the terminal channels 192 of the dielectric insert 162. As described above, the termination interfaces 164 of the terminals 156 may or may not extend outward from the rear face 190 of the dielectric insert 162 when the termination interfaces 164 are held by the dielectric insert 162 within the terminal channels 192. The termination interfaces 164 of the terminals 156 are terminated to the conductors 166 of the cable 118. Specifically, the termination interfaces 164 are crimped to the corresponding conductors 166 such that the terminals 156 are electrically or optically connected to the corresponding conductors 166.

The dielectric inserts 60 and 162 are engaged together in the assembled state of the terminal assembly 136. Specifically, the towers 80 of the dielectric insert 60 are received into (i.e., nested) within corresponding recesses 196 of the dielectric insert 162. The nesting of the towers 80 within the recesses 196 may facilitate sealing (e.g., environmental sealing, electrical sealing, and/or the like) the rear face 74 of the dielectric insert 60 with the front face 188 of the dielectric insert 162 and/or may facilitate alignment of the rear face 74 and the front face 188 during assembly of the terminal subassembly 136. Optionally, the rear face 74 of the dielectric insert 60 and the front face 188 of the dielectric insert 162 are bonded together, such as, but not limited to, using an adhesive, an epoxy, and/or the like.

As should be apparent from the discussion of the electrical connectors 14 (FIGS. 1-3) and 114 and FIGS. 1-8, the dielectric insert 60 is a modular insert that is: (1) configured to hold terminals having termination interfaces that are flat interfaces that are configured to be terminated to the conductors of a cable using a weld, solder, and/or a bond; and (2) is also configured to hold terminals having termination interfaces that are that are crimp interfaces for terminating the terminals to the conductors of a cable using crimps. For example, the terminal channels 76 of the dielectric insert 60 are configured to selectively hold both the intermediate segments (e.g., the intermediate segments 68 shown in FIGS. 3-5) of terminals (e.g., the terminals 56 shown in FIGS. 2-5) having termination interfaces (e.g., the termination interfaces 64 shown in FIGS. 3-5) that are flat interfaces and the intermediate segments (e.g., the intermediate segments 168) of terminals (e.g., the terminals 156) having termination interfaces (e.g., the termination interfaces 164) that are crimp interfaces. In other words, the dielectric insert 60 is configured to be selectively used with both an electrical connector that terminates to a cable using welds, solder, and/or bonds and an electrical connector that terminates to a cable using crimps.

FIG. 9 is a partially exploded perspective view of an embodiment of the electrical connector 12. The electrical connector 12 includes a shell 234, a terminal subassembly 236 held by the shell 234, and a cable clamp 238. The shell 234 extends from a mating end 240 to an opposite termination end 242. The shell 234 includes an internal cavity 244 that extends between the mating end 240 and the termination end 242. The terminal subassembly 236 is configured to be held within the cavity 244.

The shell 234 is configured to be mated to the electrical connector 14 (FIGS. 1-3) at the mating end 240 of the shell 234. In the illustrated embodiment, the fasteners 30 of the electrical connector 12 are provided along the mating end 240 of the shell 234 at opposite sides of the shell 234 to secure the electrical connectors 12 and 14 as mated together. But, the fasteners 30 may additionally or alternatively include any other location along the shell 234.

Optionally, the shell 234 is manufactured from an electrically conductive material (such as, but not limited to, a metal material, a composite material, and/or the like) such that the shell 234 provides electrical shielding around the terminal subassembly 236. The shell 234 may be electrically connected to an electrical shield (not shown) of the cable 16 to facilitate such electrical shielding.

The cable clamp 238 is mounted to the shell 234 at the termination end 242 of the shell 234. The cable clamp 238 includes opposing clamping members 250 and 252 that are configured to clamp the cable 16 therebetween at the termination end 242 of the shell 234. The cable clamp 238 may provide the cable 16 with strain relief. The cable clamp 238 is substantially similar to the cable clamp 38 (FIGS. 1, 2, and 6) and therefore will not be described in more detail herein.

The terminal subassembly 236 is held within the cavity 244 of the shell 234. The terminal subassembly 236 includes the terminals 256, a dielectric insert 260, and a dielectric insert 262. The terminals 256 are held by the dielectric inserts 260 and 262, and dielectric inserts 260 and 262 are held within the cavity 244 of the shell 234. As will be described below, the dielectric insert 260 is a modular insert that is: (1) configured to hold the terminals 256, which include termination interfaces 264 that are flat interfaces for terminating the terminals 256 to the cable 16 using a weld, solder, and/or a bond; and (2) is also configured to hold terminals (e.g., the terminals 356 shown in FIG. 10) that include termination interfaces (e.g., the termination interfaces 364 shown in FIG. 10) that are crimp interfaces for terminating the terminals to a corresponding cable (e.g., the cable 116 shown in FIG. 10) using crimps. In other words, the dielectric insert 260 is configured to be selectively used with both an electrical connector that terminates to a cable using welds, solder, and/or bonds and an electrical connector that terminates to a cable using crimps. The dielectric insert 260 may be referred to herein as a "front" dielectric insert, while the dielectric insert 262 may be referred to herein as a "rear" dielectric insert.

The terminals 256 include the mating interfaces 254 and the termination interfaces 264. The terminals 256 are configured to mate with the corresponding terminals 56 (FIGS. 2-5) of the electrical connector 12 (FIGS. 1-5) at the mating interfaces 256. In the illustrated embodiment, the mating interfaces 254 are sockets that are configured to receive pins of the corresponding terminals 56 of the electrical connector 14. Alternatively, the mating interfaces 254 can be pins that are configured to be received within sockets of the corresponding terminals 56 of the electrical connector 14. In still other embodiments, the mating interfaces 254 of the terminals 256 have another structure, such as, but not limited to, a blade structure, a spring finger structure, and/or the like. The terminals 256 may be copper based electrical terminals or fiberoptic terminals, depending on the particular application. In the illustrated embodiment, the electrical connector 12 includes ten terminals 256, although only two are shown in FIG. 9. But, the electrical connector 12 may include any number of the terminals 256, such as, but not limited to, eight terminals 256, nine terminals 256, twelve terminals 256, sixteen terminals 256, eighteen terminals 256, or twenty terminals 256.

The terminals 256 are configured to be terminated to corresponding conductors 266 of the cable 16 at the termination interfaces 264. In the illustrated embodiment, the cable 16 is a ribbon cable having the generally shape of a ribbon. The cable 16 includes the conductors 266, which in the illustrated embodiment of the ribbon cable 16 have an approximately flat (i.e., planar) shape. In the illustrated embodiment, the termination interfaces 264 of the terminals 256 are flat interfaces that are configured to be terminated to the corresponding conductors 266 using welds, solder, and/or bonds. Although nine conductors 266 are shown, the cable 16 may include any number of the conductors 266. Optionally, the termination interfaces 264 of two of the terminals 256 are terminated to a single conductor 266.

The terminals 256 include intermediate segments 268 that extend between, and interconnect, the mating interfaces 254 and the termination interfaces 264. In the illustrated embodiment, the intermediate segments 268 have a cylindrical shape. But, the intermediate segments 268 of the terminals 256 may alternatively include any other shape.

The dielectric insert 260 includes a body 270 that extends from a front face 272 to an opposite rear face 274. The body 270 of the dielectric insert 260 is manufactured from a dielectric material. Optionally, at least a portion of the body 270 of the dielectric insert 260 is metalized and/or has a metal shield surrounding such portion to provide electrical shielding for the terminals 256. A front end 273 of the body 270 of the dielectric insert 260 defines the plug 246, which is configured to be received within the receptacle 46 (FIGS. 2 and 3) of the electrical connector 12 when the electrical connectors 12 and 14 are mated together. The front end 273 includes the front face 272.

The body 270 of the dielectric insert 260 includes terminal channels 276 that extend through the body 270. The dielectric inserts 260 and 262 are configured to hold the terminals 256. Specifically, each terminal channel 276 is configured to hold at least a portion of the intermediate segment 268 and at least a portion of the mating segment 254 of a corresponding terminal 256. Optionally, one or more of the terminals channels 276 does not hold a terminal 256 therein such that the terminal channel 276 is "blanked out".

Each terminal channel 276 has a complementary shape relative to the intermediate segment 268 and/or the mating interface 254 of the corresponding terminal 256. In the illustrated embodiment, the terminal channels 276 have cylindrical shapes that are complementary with the cylindrical shapes of the exemplary intermediate segments 268 and the exemplary mating interfaces 254. But, the terminal channels 276 may additionally or alternatively include any other shape, for example in embodiments wherein the intermediate segments 268 and/or the mating interfaces 254 include other shapes than the cylindrical shapes shown herein. Each terminal channel 276 is configured to receive the intermediate segment 268 and/or the mating interfaces 254 of the corresponding terminal 256 therein such that the dielectric insert 260 securely holds the terminal 256. The terminal channels 276 may receive the corresponding intermediate segments 68 and/or mating interface 254 with any type of connection, structure, means, and/or the like that enables the terminal channels 276 to securely hold the corresponding intermediate segments 268 and/or mating interfaces 254. In the illustrated embodiment, each of the terminal channels 276 receives the intermediate segment 268 and/or the mating interface 254 of the corresponding terminal 256 with an interference fit to securely hold the terminal 256. But, in addition or alternative to the interference fit, each terminal channel 276 may receive the intermediate segment 268 and/or the mating interface 254 with any other type of connection, structure, means, and/or the like, such as, but not limited to, using a snap-fit, using an adhesive, and/or the like.

The rear face 274 of the dielectric insert 260 includes a base surface 278 and towers 280 that extend outward from the base surface 278. The towers 280 are configured to nest within recesses 296 of the dielectric insert 262, for example to facilitate sealing (e.g., environmental sealing, electrical sealing, and/or the like) the rear face 274 of the dielectric insert 260 with a front face 288 of the dielectric insert 262 and/or to facilitate alignment of the rear face 274 and the front face 288. The shape of each tower 280 is complementary with the shape of the corresponding recess 296. In the illustrated embodiment, the towers 280 have cylindrical shapes, but the towers 280 may additionally or alternatively include any other shape, such as, but not limited to, a rectangular shape, a parallelepiped shape, a triangular shape, an oval shape, a square shape, and/or the like.

The front face 272 of the dielectric insert 260 includes a base surface 282 and towers 284 that extend from the base surface 282. The towers 284 are configured to be received (i.e., nested) within the recesses 84 (FIG. 4) of the dielectric insert 60 (FIGS. 3-5) of the electrical connector 14 when the electrical connectors 12 and 14 are mated together. In other words, the front face 272 of the dielectric insert 260 is configured to mate with the front face 72 of the dielectric insert 60 as the electrical connectors 12 and 14 mate together such that the towers 284 nest within corresponding recesses 84. The reception of the towers 284 of the dielectric insert 260 within the recesses 84 of the dielectric insert 60 may facilitate electrically sealing the dielectric inserts 260 and 60 by blocking a line-of-sight path between adjacent pairs of mated terminals 56 and 256, which may prevent electrical arching and/or other electrical interference between adjacent pairs of mated terminals 56 and 256. The nesting of the towers 284 within the recesses 84 is such that the dielectric inserts 60 and 260 do not include a fluorosilicone material that forms any portion of the mating between the front faces 72 and 272.

The shape of each tower 284 is complementary with the shape of the corresponding recess 84. Although shown as having a cylindrical shape, the towers 284 may additionally or alternatively include any other shape, such as, but not limited to, a rectangular shape, a parallelepiped shape, a triangular shape, an oval shape, a square shape, and/or the like.

The towers 284, the terminal channels 276, and the base surface 282 are integrally formed with at least a portion of the body 270 of the dielectric insert 260 such that the dielectric insert 260 includes a unitary body 270 that includes the towers 284, the terminal channels 276, and the base surface 282. The unitary body 270 may be fabricated using any process, such as, but not limited to, a molding process, a casting process, and/or the like. In some embodiments, the unitary body 270 is fabricated using a molding process such that the towers 284 are molded towers 284.

The dielectric insert 262 includes a body 286 that extends from the front face 288 to an opposite rear face 290. The body 286 of the dielectric insert 262 is manufactured from a dielectric material. Optionally, at least a portion of the body 286 of the dielectric insert 262 is metalized and/or has a metal shield surrounding such portion to provide electrical shielding for the terminals 256.

The body 286 of the dielectric insert 262 includes terminal channels 292 that extend through the body 286. Each terminal channel 292 is configured to hold the termination interface 264 of a corresponding terminal 256. As should be apparent from FIG. 9, the termination interfaces 264 of the terminals 256 extend outward from the rear face 290 of the dielectric insert 262 when the termination interfaces 264 are held by the dielectric insert 262 within the terminal channels 292.

Each terminal channel 292 has a complementary shape relative to the termination interface 264 of the corresponding terminal 256. In the illustrated embodiment, the terminal channels 292 have generally parallelepiped shapes that are complementary with the approximately flat shapes of the exemplary termination interfaces 264. But, the terminal channels 292 may additionally or alternatively include any other shape, for example in embodiments wherein the cable segments 264 include other shapes than the approximately flat shapes shown herein. The terminal channels 292 may receive the corresponding termination interfaces 264 with any type of connection, structure, means, and/or the like, such as, but not limited to, with a loose (i.e., floating) fit, with an interference fit, using a snap-fit, using an adhesive, and/or the like. Optionally, each terminal channel 292 is also configured to hold a portion of the intermediate segment 268 of the corresponding terminal 256.

The front face 288 of the dielectric insert 262 includes a base surface 294 and the recesses 296, which extend into the base surface 294. As described above, the recesses 296 are configured receive the towers 280 of the dielectric insert 260, for example to facilitate sealing (e.g., environmental sealing, electrical sealing, and/or the like) the rear face 274 of the dielectric insert 260 with the front face 288 of the dielectric insert 262 and/or to facilitate alignment of the rear face 274 and the front face 288. The shape of each recess 296 is complementary with the shape of the corresponding tower 280. Although shown as having a cylindrical shape, the recesses 296 may additionally or alternatively include any other shape, such as, but not limited to, a rectangular shape, a parallelepiped shape, a triangular shape, an oval shape, a square shape, and/or the like.

When the terminal subassembly 236 is assembled and held within the cavity 244 of the shell 234, at least portions of the intermediate segments 268 and at least portions of the mating interfaces 254 of the terminals 256 are held within the terminal channels 276 of the dielectric insert 260. The termination interfaces 264 are held within the terminal channels 292 of the dielectric insert 262. As can be seen in FIG. 9, the termination interfaces 264 of the terminals 256 extend outward from the rear face 290 of the dielectric insert 262. The termination interfaces 264 of the terminals 256 are terminated to the conductors 266 of the cable 16. Specifically, the termination interfaces 264 are terminated to the conductors 266 using welds, solder, and/or bonds such that the terminals 256 are electrically or optically connected to the corresponding conductors 66.

The dielectric inserts 260 and 262 are engaged together in the assembled state of the terminal assembly 236. Specifically, the towers 280 of the dielectric insert 260 are received into (i.e., nested) within corresponding recesses 296 of the dielectric insert 262. The nesting of the towers 280 within the recesses 296 may facilitate sealing (e.g., environmental sealing, electrical sealing, and/or the like) the rear face 274 of the dielectric insert 260 with the front face 288 of the dielectric insert 262 and/or may facilitate alignment of the rear face 274 and the front face 288 during assembly of the terminal subassembly 236. Optionally, the rear face 274 of the dielectric insert 260 and the front face 288 of the dielectric insert 262 are bonded together, such as, but not limited to, using an adhesive, an epoxy, and/or the like.

The dielectric insert 262 is substantially identical to the dielectric insert 62 shown in FIGS. 3-5. Although labeled with different reference numerals, the dielectric insert 62 may be used in the electrical connector 12 in place of the dielectric insert 262, and the dielectric insert 262 may be used in the electrical connector 14 in place of the dielectric insert 62. Accordingly, each of the dielectric inserts 62 and 262 is a modular insert that is configured to be held by a shell (e.g., the shell 34) of an electrical connector when the electrical connector is a receptacle connector (e.g., the electrical connector 14) and that is also configured to be held by a shell (e.g., the shell 234) when the electrical connector is a plug connector (e.g., the electrical connector 12). In other words, each of the dielectric inserts 62 and 262 is configured to be selectively used with both an electrical connector that is a receptacle connector and an electrical connector that is a plug connector.

The dielectric insert 60 is a modular insert that is: (1) configured to hold terminals having termination interfaces that are flat interfaces that are configured to be terminated to the conductors of a cable using a weld, solder, and/or bond (e.g. the terminals 256 having the termination interfaces 264); and (2) is also configured to hold terminals having termination interfaces that are that are crimp interfaces for terminating the terminals to the conductors of a cable using crimps. In other words, the dielectric insert 260 is configured to be selectively used with both an electrical connector that terminates to a cable using welds, solder, and/or bonds and an electrical connector that terminates to a cable using crimps.

For example, FIG. 10 is an exploded perspective detailed view of an embodiment of the electrical connector 112. The electrical connector 112 includes the dielectric insert 260 and terminates to a cable 116 using crimps. The electrical connector 112 includes a shell 334, a terminal subassembly 336 held by the shell 334, and a cable clamp 338. The shell 334 extends from a mating end 340 to an opposite termination end 342. The shell 334 includes an internal cavity 344 that extends between the mating end 340 and the termination end 342. The terminal subassembly 336 is configured to be held within the cavity 344.

The shell 334 is configured to be mated to the electrical connector 114 (FIGS. 6-8) at the mating end 340 of the shell 334. In the illustrated embodiment, the fasteners 130 of the electrical connector 112 are provided along the mating end 340 of the shell 334 at opposite sides of the shell 334 to secure the electrical connectors 112 and 114 as mated together. But, the fasteners 130 may additionally or alternatively include any other location along the shell 334.

Optionally, the shell 334 is manufactured from an electrically conductive material (such as, but not limited to, a metal material, a composite material, and/or the like) such that the shell 334 provides electrical shielding around the terminal subassembly 336. The shell 334 may be electrically connected to an electrical shield (not shown) of the cable 116 to facilitate such electrical shielding.

The cable clamp 338 is mounted to the shell 334 at the termination end 342 and includes opposing clamping members 350 and 352 that are configured to clamp the cable 116 therebetween at the termination end 342 of the shell 334. The cable clamp 338 may provide the cable 116 with strain relief. The cable clamp 338 is substantially similar to the cable clamp 138 (FIGS. 6 and 7) and therefore will not be described in more detail herein.

The terminal subassembly 336 is held within the cavity 344 of the shell 334. The terminal subassembly 336 includes the terminals 356, the dielectric insert 260, and a dielectric insert 362. The terminals 356 are held by the dielectric inserts 260 and 362. As should be apparent from FIGS. 6 and 10, the dielectric inserts 260 and 362 are held within the cavity 344 of the shell 334. The dielectric insert 362 may be referred to herein as a "rear" dielectric insert.

The terminals 356 include the mating interfaces 354 and termination interfaces 364. In the illustrated embodiment, the mating interfaces 354 are sockets that are configured to receive pins of the corresponding terminals 156 of the electrical connector 114. Alternatively, the mating interfaces 354 can be pins that are configured to be received within sockets of the corresponding terminals 156 of the electrical connector 114. In still other embodiments, the mating interfaces 354 of the terminals 356 have another structure, such as, but not limited to, a blade structure, a spring finger structure, and/or the like. The terminals 356 may be copper based electrical terminals or fiberoptic terminals, depending on the particular application. In the illustrated embodiment, the electrical connector 112 includes ten terminals 356, although only one is shown in FIG. 10 for clarity. But, the electrical connector 112 may include any number of the terminals 356, such as, but not limited to, eight terminals 356, nine terminals 356, twelve terminals 356, sixteen terminals 356, eighteen terminals 356, or twenty terminals 356.

The terminals 356 are configured to be terminated to corresponding conductors 366 of the cable 116 at the termination interfaces 364. In the illustrated embodiment, the cable 116 is a cylindrical cable having cylindrical shape. The cable 116 includes the conductors 366, which in the illustrated embodiment of the cable 116 have cylindrical shapes. The termination interfaces 364 of the terminals 356 are crimp interfaces that are configured to be terminated to the corresponding conductors 366 using crimps. Specifically, the illustrated embodiment, the termination interfaces 364 are crimp barrels that are configured to receive and be crimped around the corresponding conductor 366. In addition or alternatively to the crimp barrels, the termination interfaces 364 may have any other structure that enables the termination interfaces 364 to be crimped to the conductors 366. Although ten are shown, the cable 318 may include any number of the conductors 366.

The terminals 356 include intermediate segments 368 that extend between, and interconnect, the mating interfaces 354 and the termination interfaces 364. In the illustrated embodiment, the intermediate segments 368 have a cylindrical shape. But, the intermediate segments 368 of the terminals 356 may alternatively include any other shape.

The front end 273 of the body 270 of the dielectric insert 260 defines a plug 346 of the electrical connector 112. The plug 346 is configured to be received within the receptacle 146 (FIGS. 7 and 8) of the electrical connector 114 when the electrical connectors 112 and 114 are mated together.

The dielectric inserts 260 and 362 are configured to hold the terminals 356. Specifically, each terminal channel 276 of the dielectric insert 260 is configured to hold at least a portion of the intermediate segment 368 and at least a portion of the mating interface 354 of a corresponding terminal 356. Optionally, one or more of the terminals channels 276 does not hold a terminal 356 therein such that the terminal channel 276 is "blanked out". Each terminal channel 276 has a complementary shape relative to the intermediate segment 368 and/or the mating interface 354 of the corresponding terminal 356. In the illustrated embodiment, the terminal channels 276 have cylindrical shapes that are complementary with the cylindrical shapes of the exemplary intermediate segments 368 and the exemplary mating interfaces 354. But, the terminal channels 276 may additionally or alternatively include any other shape, for example in embodiments wherein the intermediate segments 368 and/or the mating interfaces 354 include other shapes than the cylindrical shapes shown herein. Each terminal channel 276 is configured to receive the intermediate segment 368 and/or the mating interface 354 of the corresponding terminal 356 therein such that the dielectric insert 260 securely holds the terminal 356. The terminal channels 276 may receive the corresponding intermediate segments 368 and/or mating interfaces 354 with any type of connection, structure, means, and/or the like that enables the terminal channels 276 to securely hold the corresponding intermediate segments 368 and/or mating interfaces 354. In the illustrated embodiment, each of the terminal channels 276 receives the intermediate segment 368 and/or the mating interface 354 of the corresponding terminal 356 with an interference fit to securely hold the terminal 356. But, in addition or alternative to the interference fit, each terminal channel 276 may receive the intermediate segment 368 and/or the mating interface 354 with any other type of connection, structure, means, and/or the like, such as, but not limited to, using a snap-fit, using an adhesive, and/or the like.

The towers 284 of the dielectric insert 260 are configured to be received (i.e., nested) within the recesses 84 (FIGS. 4 and 8) of the dielectric insert 60 (FIGS. 3-5 and 8) of the electrical connector 114 (FIGS. 6-8) when the electrical connectors 112 and 114 are mated together. The reception of the towers 284 of the dielectric insert 260 within the recesses 84 of the dielectric insert 60 may facilitate electrically sealing the dielectric inserts 260 and 60 by blocking a line-of-sight path between adjacent pairs of mated terminals 156 and 356, which may prevent electrical arching and/or other electrical interference between adjacent pairs of mated terminals 156 and 356. The nesting of the towers 284 within the recesses 84 is such that the dielectric inserts 60 and 260 do not include a fluorosilicone material that forms any portion of the mating between the front faces 72 and 272.

The dielectric insert 362 includes a body 386 that extends from a front face 388 to an opposite rear face 390. The body 386 of the dielectric insert 362 is manufactured from a dielectric material. Optionally, at least a portion of the body 386 of the dielectric insert 362 is metalized and/or has a metal shield surrounding such portion to provide electrical shielding for the terminals 356.

The body 386 of the dielectric insert 362 includes terminal channels 392 that extend through the body 386. Each terminal channel 392 is configured to hold the termination interface 364 of a corresponding terminal 356. The termination interfaces 364 of the terminals 356 may or may not extend outward from the rear face 390 of the dielectric insert 362 when the termination interfaces 364 are held by the dielectric insert 362 within the terminal channels 392.

Each terminal channel 392 has a complementary shape relative to the termination interface 364 of the corresponding terminal 356. In the illustrated embodiment, the terminal channels 392 have generally cylindrical shapes that are complementary with the cylindrical shapes of the exemplary termination interfaces 364. But, the terminal channels 392 may additionally or alternatively include any other shape, for example in embodiments wherein the cable segments 364 include other shapes than the approximately flat shapes shown herein. The terminal channels 392 may receive the corresponding termination interfaces 364 with any type of connection, structure, means, and/or the like, such as, but not limited to, with a loose (i.e., floating) fit, with an interference fit, using a snap-fit, using an adhesive, and/or the like. Optionally, each terminal channel 392 is also configured to hold a portion of the intermediate segment 368 of the corresponding terminal 356.

The front face 388 of the dielectric insert 362 includes a base surface 394 and recesses 396, which extend into the base surface 394. The recesses 396 are configured receive the towers 280 of the dielectric insert 260, for example to facilitate sealing (e.g., environmental sealing, electrical sealing, and/or the like) the rear face 274 of the dielectric insert 260 with the front face 388 of the dielectric insert 362 and/or to facilitate alignment of the rear face 274 and the front face 388. The shape of each recess 396 is complementary with the shape of the corresponding tower 280. Although having a cylindrical shape in the illustrated embodiment, the recesses 396 may additionally or alternatively include any other shape, such as, but not limited to, a rectangular shape, a parallelepiped shape, a triangular shape, an oval shape, a square shape, and/or the like.

When the terminal subassembly 336 is assembled and held by the shell 334, the terminals 356 are held by the dielectric inserts 260 and 362. At least portions of the intermediate segments 368 and at least portions of the mating interfaces 354 of the terminals 356 are held within the terminal channels 276 of the dielectric insert 260. The termination interfaces 364 are held within the terminal channels 392 of the dielectric insert 362. The termination interfaces 364 of the terminals 356 may or may not extend outward from the rear face 390 of the dielectric insert 362 when the termination interfaces 364 are held by the dielectric insert 362 within the terminal channels 392. The termination interfaces 364 of the terminals 356 are terminated to the conductors 366 of the cable 116. Specifically, the termination interfaces 364 are crimped to the corresponding conductors 366 such that the terminals 356 are electrically or optically connected to the corresponding conductors 366.

The dielectric inserts 260 and 362 are engaged together in the assembled state of the terminal assembly 336. Specifically, the towers 280 of the dielectric insert 260 are received into (i.e., nested) within corresponding recesses 396 of the dielectric insert 362. The nesting of the towers 280 within the recesses 396 may facilitate sealing (e.g., environmental sealing, electrical sealing, and/or the like) the rear face 274 of the dielectric insert 260 with the front face 388 of the dielectric insert 362 and/or may facilitate alignment of the rear face 274 and the front face 388 during assembly of the terminal subassembly 336. Optionally, the rear face 274 of the dielectric insert 260 and the front face 388 of the dielectric insert 362 are bonded together, such as, but not limited to, using an adhesive, an epoxy, and/or the like.

The dielectric insert 362 is substantially identical to the dielectric insert 162 shown in FIG. 8. Although labeled with different reference numerals, the dielectric insert 162 may be used in the electrical connector 112 in place of the dielectric insert 362, and the dielectric insert 362 may be used in the electrical connector 114 in place of the dielectric insert 162. Accordingly, each of the dielectric inserts 162 and 362 is a modular insert that is configured to be held by a shell (e.g., the shell 134) of an electrical connector when the electrical connector is a receptacle connector (e.g., the electrical connector 114) and that is also configured to be held by a shell (e.g., the shell 334) when the electrical connector is a plug connector (e.g., the electrical connector 112). In other words, each of the dielectric inserts 162 and 362 is configured to be selectively used with both an electrical connector that is a receptacle connector and an electrical connector that is a plug connector.

As should be apparent from the discussion of the electrical connectors 12 and 112 and FIGS. 6-10, the dielectric insert 260 is a modular insert that is: (1) configured to hold terminals having termination interfaces that are flat interfaces that are configured to be terminated to the conductors of a cable using welds, solder, and/or bonds; and (2) is also configured to hold terminals having termination interfaces that are that are crimp interfaces for terminating the terminals to the conductors of a cable using crimps. For example, the terminal channels 276 of the dielectric insert 260 are configured to selectively hold both the intermediate segments (e.g., the intermediate segments 268 shown in FIG. 9) of terminals (e.g., the terminals 256 shown in FIG. 9) having termination interfaces (e.g., the termination interfaces 264 shown in FIG. 9) that are flat interfaces and the intermediate segments (e.g., the intermediate segments 368) of terminals (e.g., the terminals 356) having termination interfaces (e.g., the termination interfaces 364) that are crimp interfaces. In other words, the dielectric insert 260 is configured to be selectively used with both an electrical connector that terminates to a cable using welds, solder, and/or bonds and an electrical connector that terminates to a cable using crimps.

The embodiments described and/or illustrated herein may provide an electrical connector system that has interchangeable inserts such that the electrical connector system has less different components than at least some known electrical connector systems. The embodiments described and/or illustrated herein may provide an electrical connector that is for use in outer space and/or earth orbit environments. For example, the embodiments described and/or illustrated herein may provide an electrical connector that is suitable for use onboard a satellite.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a shell having a mating end and a termination end, the shell having a securing feature configured to secure the shell to a mating connector, the shell having a cavity that extends between the mating end and the termination end; and a terminal subassembly comprising a front dielectric insert and interchangeable first and second rear dielectric inserts, the terminal subassembly in a first configuration including the front dielectric insert and the first rear dielectric insert that are configured to be held within the cavity of the shell, the terminal subassembly in a second configuration including the front dielectric insert and the second rear dielectric insert that are configured to be held within the cavity of the shell, the front dielectric insert and the first and second rear dielectric inserts being configured to hold terminals such that mating interfaces of the terminals are configured to mate with corresponding terminals of the mating connector and such that termination interfaces of the terminals are configured to be terminated to a cable, wherein the first configuration of the terminal subassembly is configured to hold the terminals when the termination interfaces are flat interfaces and the second configuration of the terminal subassembly is configured to hold the terminals when the termination interfaces are crimp interfaces such that the front dielectric insert is configured to hold the terminals when the termination interfaces are flat interfaces and is also configured to hold the terminals when the termination interfaces are crimp interfaces.

2. The electrical connector of claim 1, wherein the front dielectric insert comprises terminal channels that have a complementary shape relative to intermediate segments of the terminals that extend between the mating and termination interfaces of the terminals, each terminal channel being configured to selectively hold both the intermediate segment of a corresponding terminal having the flat interface and the intermediate segment of a corresponding terminal having the crimp interface.

3. The electrical connector of claim 1, wherein the front dielectric insert comprises terminal channels that have a complementary shape relative to intermediate segments of the terminals that extend between the mating and termination interfaces of the terminals, each terminal channel being configured to selectively hold with an interference fit both the intermediate segment of a corresponding terminal having the flat interface and the intermediate segment of a corresponding terminal having the crimp interface.

4. The electrical connector of claim 1, wherein the front dielectric insert is configured to hold intermediate segments of the terminals that extend between the mating and termination interfaces of the terminals, the first and second rear dielectric inserts being configured to hold the termination interfaces of the terminals such that the first rear dielectric insert in the first configuration of the terminal subassembly holds the termination interfaces that are flat interfaces and the second rear dielectric insert in the second configuration of the terminal subassembly holds the termination interfaces that are crimp interfaces.

5. The electrical connector of claim 1, wherein a front face of the first rear dielectric insert engages a rear face of the front dielectric insert in the first configuration of the terminal subassembly and a front face of the second rear dielectric insert engages the rear face of the front dielectric insert in the second configuration of the terminal subassembly.

6. The electrical connector of claim 1, wherein the shell has a generally wide and short configuration defining a low profile shell.

7. The electrical connector of claim 1, wherein the electrical connector is configured to be arranged side-by-side in a row with another electrical connector, the electrical connector also being configured to be stacked in a column with the other electrical connector.

8. The electrical connector of claim 1, wherein each of the first and second rear dielectric inserts has a front face, a rear face, and terminal channels that extend between the respective front and rear faces, each terminal channel being configured to hold the termination interface of a corresponding one of the terminals therein, wherein at least a segment of each of the terminal channels of the first rear dielectric insert has a generally parallelepiped shape that is complementary with a shape of the flat interface of the corresponding terminal, and each of the terminal channels of the second rear dielectric insert has a generally cylindrical shape that is complementary with a shape of the crimp interface of the corresponding terminal.

9. The electrical connector of claim 1, wherein the front dielectric insert includes a rear face having a base surface and towers that extend outward from the base surface, the first and second rear dielectric inserts each including a front face that has a base surface and recesses that extend into the base surface, the recesses of each of the first and second rear dielectric inserts being configured to receive the towers of the front dielectric insert to facilitate at least one of alignment or sealing of the rear face of the front dielectric insert with the front face of the first rear dielectric insert in the first configuration of the terminal subassembly and with the front face of the second rear dielectric insert in the second configuration of the terminal subassembly.

10. An electrical connector comprising:

a shell having a mating end and a termination end, the shell having a securing feature configured to secure the shell to a mating connector, the shell having a cavity that extends between the mating end and the termination end;

a terminal subassembly comprising terminals that are held within the cavity of the shell, the terminals having termination interfaces that are configured to be terminated to a cable; and a cable clamp comprising opposing clamping members that are configured to clamp the cable therebetween at the termination end of the shell, each clamping member having a unitary body that includes both an actuation segment and a pressing surface, the pressing surfaces being configured to face each other and engage the cable therebetween, the actuation segment of each clamping member being configured to cooperate with the other clamping member to move the pressing surfaces toward each other, wherein at least one of the pressing surfaces has a shape that is complementary with a shape of the cable, wherein the actuation segments of the unitary bodies of the clamping members comprise openings that are configured to receive threaded fasteners to move the pressing surfaces toward each other.

11. The electrical connector of claim 10, wherein the cable is a ribbon cable having a ribbon shape, the complementary shape of the at least one of the pressing surfaces being an undulating shape that is complementary with the ribbon shape of the ribbon cable.

12. The electrical connector of claim 10, wherein the cable is a cylindrical cable having a plurality of conductors having cylindrical shapes, the complementary shape of the at least one of the pressing surfaces comprising a plurality of partially cylindrical channels that are complementary with the cylindrical shapes of the conductors.

13. The electrical connector of claim 10, wherein the pressing surface of at least one of the clamping members is coated with a silicone rubber material.

14. The electrical connector of claim 10, wherein the unitary bodies of the clamping members are fabricated from one or more metals such that the unitary bodies are metallic bodies.

15. The electrical connector of claim 10, wherein the cable clamp does not include a fluorosilicone material that extends along the pressing surfaces.

16. The electrical connector of claim 10, wherein the shell has a generally wide and short configuration defining a low profile shell.

17. An electrical connector comprising:

a shell having a mating end and a termination end, the shell having a securing feature configured to secure the shell to a mating connector, the shell having a cavity that extends between the mating end and the termination end; and a terminal subassembly comprising a dielectric insert held within the cavity of the shell and terminals that are held by the dielectric insert, the dielectric insert comprises a front face having a base surface and towers that extend outward from the base surface, wherein the front face is configured to mate with another dielectric insert of the mating connector as the electrical connector mates with the mating connector such that the towers nest within corresponding recesses of the other dielectric insert of the mating connector.

18. The electrical connector of claim 17, wherein the dielectric insert comprises a unitary body that includes the base surface, the towers, and terminal channels that hold intermediate segments of the terminals that extend between mating interfaces of the terminals and termination interfaces of the terminals.

19. The electrical connector of claim 17, wherein the dielectric insert comprises a unitary body that includes the base surface, the towers, and terminal channels that hold intermediate segments of the terminals that extend between mating interfaces of the terminals and termination interfaces of the terminals, the unitary body being fabricated using a molding process such that the towers are molded towers.

20. The electrical connector of claim 17, wherein the dielectric insert does not include a fluorosilicone material that forms any portion of a seal between the front face of the dielectric insert and the other dielectric insert of the mating connector.

* * * * *